US009072420B2

(12) United States Patent
Fukuzawa et al.

(10) Patent No.: US 9,072,420 B2
(45) Date of Patent: Jul. 7, 2015

(54) CLEANING TOOL

(75) Inventors: Masumi Fukuzawa, Kagawa (JP); Tomokazu Suda, Kagawa (JP)

(73) Assignee: Unicharm Corporation, Ehime (JP)

( * ) Notice: Subject to any disclaimer, the term of this patent is extended or adjusted under 35 U.S.C. 154(b) by 417 days.

(21) Appl. No.: 13/577,076

(22) PCT Filed: Feb. 3, 2011

(86) PCT No.: PCT/JP2011/052241

§ 371 (c)(1),
(2), (4) Date: Oct. 18, 2012

(87) PCT Pub. No.: WO2011/096474

PCT Pub. Date: Aug. 11, 2011

(65) Prior Publication Data

US 2013/0031738 A1 Feb. 7, 2013

(30) Foreign Application Priority Data

Feb. 3, 2010 (JP) ..... 2010-022602

(51) Int. Cl.
*A47L 13/38* (2006.01)
*A47L 13/16* (2006.01)
*A47L 13/46* (2006.01)

(52) U.S. Cl.
CPC *A47L 13/38* (2013.01); *A47L 13/46* (2013.01)

(58) Field of Classification Search
CPC ..... A47L 13/16; A47L 13/20; A47L 13/28; A47L 13/38; A47L 13/46
USPC ..... 15/209.1, 210.1
See application file for complete search history.

(56) References Cited

U.S. PATENT DOCUMENTS

| | | | | |
|---|---|---|---|---|
| 2007/0033761 | A1* | 2/2007 | Yang et al. | 15/226 |
| 2010/0154156 | A1* | 6/2010 | Takabayashi et al. | 15/209.1 |
| 2011/0119852 | A1* | 5/2011 | Tanaka et al. | 15/209.1 |
| 2012/0073075 | A1* | 3/2012 | Tanaka et al. | 15/231 |

FOREIGN PATENT DOCUMENTS

| | | | |
|---|---|---|---|
| JP | 2003-265390 | A | 9/2003 |
| JP | 2005-161051 | A | 6/2005 |
| JP | 2007-029136 | A | 2/2007 |
| WO | WO 03/070080 | A1 | 8/2003 |

OTHER PUBLICATIONS

International Search Report from corresponding PCT application No. PCT/JP2011/052241 filed May 10, 2011 (4 pages).
International Preliminary Report on Patentability and Written Opinion from corresponding PCT application No. PCT/JP2011/052241 dated Sep. 27, 2012 (10 pgs).

* cited by examiner

*Primary Examiner* — Laura C Guidotti
(74) *Attorney, Agent, or Firm* — Brinks Gilson & Lione

(57) ABSTRACT

A cleaning tool that includes a cleaning element. The cleaning element includes two insert holes which receive two holding elements and extend in a first direction, a first sheet and a second sheet which are formed of nonwoven fabric, a first inner bonding part and a first outer bonding part by which the first and second sheets overlaid one on the other are bonded together and which define the first insert hole, a second inner bonding part and a second outer bonding part by which the first and second sheets overlaid one on the other are bonded together and which define the second insert hole, an intermediate region which is formed between the first inner bonding part and the second inner bonding part, and a fiber element formed by a plurality of fibers which extend in a second direction transverse to the first direction and are bonded to the first sheet in the intermediate region. When the two holding elements are inserted into the associated insert holes, the two insert holes are moved toward each other, so that the fiber element in the intermediate region is pushed out in a direction in which the fiber element is located with respect to the two insert holes.

14 Claims, 17 Drawing Sheets

CLEANING TOOL

RELATED APPLICATION

This application is a 35 U.S.C. §371 national phase filing of International Patent Application No. PCT/JP2011/052241, filed Feb. 3, 2011, through which and to which priority is claimed under 35 U.S.C. §119 to Japanese Patent Application No. 2010-022602, filed Feb. 3, 2010.

BACKGROUND OF THE INVENTION

1. Field of the Invention

The invention relates to a cleaning tool.

2. Description of the Related Art

Japanese non-examined laid-open Patent Publication No. 2007-29136 discloses a cleaning tool having a cleaning element which comprises a fabric layer and a scraping sheet.

While the known cleaning tool has certain cleaning effect, it is desired to provide higher cleaning effect.

SUMMARY OF THE INVENTION

Accordingly, it is an object of the invention to enhance cleaning effect of a cleaning tool.

The above-described object can be achieved by the claimed invention. The present invention provides the cleaning tool of independent claim 1. The dependent claims specify preferred but optional features.

A representative cleaning tool according to the invention is used for cleaning an object to be cleaned and includes a cleaning element holder and a cleaning element which is adapted to be held by the cleaning element holder. The cleaning element according the invention may be of disposable type designed for single use, disposable type designed for multiple use which can be used several times, while holding dust, dirt or other objects collected from the object to be cleaned, or reusable type which can be reused by washing. The cleaning element is preferably reversible so that the cleaning element holder may be inserted into insert spaces of the cleaning element at either end of the cleaning element.

The invention can be applied to the construction of cleaning tools for cleaning objects to be cleaned which include regions to be cleaned (floors, walls, windows, ceilings, external walls, posts, furniture, clothes, curtains, blinds, bedding, lighting, electrical cords, home electric appliances, etc.) inside and outside of houses, apartments, buildings, factories, vehicles, etc. and regions of human body parts to be cleaned. These regions to be cleaned may be either flat or curved, uneven or stepped.

The cleaning element holder according to the invention includes a grip, and a first holding element and a second holding element which extend side by side in an elongate form from the grip. The grip is designed as a part to be held by user's hand. Each of the holding elements is designed as a part for holding the cleaning element. The grip and the holding elements may be inseparably or integrally formed with each other, or they may be separably formed. Further, at least two holding elements are necessary, and one or more additional holding elements may be provided.

The cleaning element includes a first insert space and a second insert space, a first sheet and a second sheet, a first inner bonding part and a first outer bonding part, a second inner bonding part and a second outer bonding part, an intermediate region, a fiber element and a wider part. The first and second insert spaces are designed as insert spaces which receive the first and second holding elements of the cleaning element holder and extend in a first direction. In addition to the first and second insert spaces, one or more insert spaces may be provided. The "insert space extending in a first direction" here refers to an insert space extending along the first direction and includes an insert space in which its extending direction coincides or nearly coincides with the first direction in its entirety or in part. The first sheet and the second sheet are formed of nonwoven fabric. The first inner bonding part and the first outer bonding part are designed as bonding parts by which the first and second sheets overlaid one on the other are bonded together and which define the first insert space. The second inner bonding part and the second outer bonding part are designed as bonding parts by which the first and second sheets overlaid one on the other are bonded together and which define the second insert space. The intermediate region is formed between the first inner bonding part and the second inner bonding part. The fiber element is formed by a plurality of fibers which extend in a second direction transverse to the first direction and are bonded to the first sheet in the intermediate region. The fiber element may be bonded to the first sheet by a first inner bonding line and a second inner bonding line in the intermediate region, or it may be bonded to the first sheet by a different bonding part from the first and second inner bonding lines. The fiber element may comprise thermoplastic fibers. The wider part is designed as a part in which the intermediate region has a width in the second direction which is longer than a shortest distance between the first and second holding elements in a state in which the first and second holding elements of the cleaning element holder are not inserted into the first and second insert spaces of the cleaning element.

With the cleaning tool having the above-described construction, when the first and second holding elements of the cleaning element holder are inserted into the first and second insert spaces of the cleaning element, the first and second insert spaces are moved toward each other, so that the fiber element in the intermediate region is pushed out in a direction in which the fiber element is located with respect to the first and second insert spaces, or in a direction in which the first sheet and the fiber element are overlaid one on the other. By this push, fiber portions of the fiber element on the both sides of the intermediate region (for example, free ends of the fiber element having a fixed end formed by the intermediate region) increase in thickness. Therefore, the distances between fibers of the fiber element in the pushing-out direction are increased in the section of the cleaning element, so that the apparent specific volume of the fiber element can be increased compared with that of the cleaning element to which the cleaning element holder is not attached. As a result, a region for collecting dust, dirt or other objects to be collected can be extended down to the depths between the fibers. Therefore, the fiber element can be effectively used, so that the cleaning effect can be enhanced.

Further, the surface area of the fiber element can be increased by increase of the distances between the fibers of the fiber element. Therefore, the area of cleaning with one wipe is increased, so that the wiping effect is enhanced.

Further, the above-described increase of the specific volume and the surface area of the fiber element can be automatically realized by inserting the holding elements into the insert spaces. Therefore, advantageously, it is not necessary for users to take the trouble to perform any operation for increasing the volume of the cleaning element before use, for example, by loosening fibers of the fiber element by hand or by shaking the cleaning element holder with the cleaning element attached thereto. Moreover, once the cleaning element is given some shape, the shape is forcefully retained by the holding elements inserted into the insert spaces, so that the shape can be retained for a longer time with stability.

In a preferred embodiment, the fiber element is bonded to the first sheet in the intermediate region at an intermediate bonding part by means of the first and second inner bonding parts. By such construction, the cleaning element can be connected to the first sheet by utilizing the first and second inner bonding parts.

In a preferred embodiment, the fiber element is bonded to the first sheet in the intermediate region by an intermediate bonding part which is different from the first and second inner bonding parts and from the first and second outer bonding parts and extends in the first direction. In addition, or as an alternative embodiment, the fiber element may be bonded to the first sheet in the intermediate region by the first and second inner bonding parts. In addition to either or both of these embodiments, or as another alternative embodiment, the fiber element may be bonded to the first sheet in the intermediate region by the first and second outer bonding parts.

In a further aspect of the invention, a bonding part is provided in the intermediate region which bonds together all the layers forming the cleaning element. Preferably, this bonding part is the intermediate bonding part.

In a further aspect of the invention, the fiber element of the cleaning element may preferably include a plurality of fibers of a first group which are disposed to face the first sheet and a plurality of fibers of a second group which are disposed on the opposite side of the fibers of the first group from the first sheet. Further, when the first and second insert spaces are moved toward each other, fibers of the first group may swing around the intermediate region. With such a construction, the specific volume and the surface area of the fiber element which forms the cleaning element can be more reliably increased.

In a further aspect of the invention, in the cleaning element, fibers of the first group and the fibers of the second group may preferably be bonded to the first sheet in the intermediate region by an intermediate bonding part which is different from the first and second inner bonding parts and extends in the first direction, and the intermediate bonding part is designed as a center of rotation of the fibers of the first group. Thus, the fibers of the first group can more reliably swing around the intermediate region. In a preferred embodiment, the fibers of the first group are also bonded to the first sheet in the intermediate region by the first and second inner bonding parts. In addition to, or as an alternative to, the inner bonding parts, the fibers of the first group may also be bonded to the first sheet in the intermediate region by the first and second outer bonding parts. Preferably, the intermediate bonding part bonds together the fiber element and all the sheets forming the cleaning element so as to form an all-layer joining line. The intermediate bonding part, whilst extending in the first direction, may be arranged substantially centrally in the cleaning element in the second direction.

In a further aspect of the invention, the fiber element of the cleaning element may include a plurality of fibers of a first group and a plurality of fibers of a second group. Fibers of the first group may be disposed to face the first sheet and bonded to the first sheet in the intermediate region at least by the first and second inner bonding parts. The fibers of the second group may be disposed on the opposite side of the fibers of the first group from the first sheet and bonded to the first sheet in the intermediate region by the intermediate bonding part which is different from the first and second inner bonding parts and extends in the first direction. Preferably, the fibers of the first group in the fiber element are further bonded to the first sheet by the intermediate bonding part. The fibers of the first group may also be bonded to the first sheet by the first and second outer bonding parts. With such a construction, the cleaning element is provided such that, when the first and second insert spaces are moved toward each other by insertion of the cleaning element holder, the fibers of the first group swing upward with respect to the cleaning element together with the first sheet, while the fibers of the second group do not swing upward with respect to the cleaning element together with the first sheet.

In a further aspect of the invention, as to the fiber element of the cleaning element, the fibers of the first group may preferably be bonded to the first sheet by first and second external bonding parts. By such construction, bonding part to the first sheet can be increased to enhance the operability in swinging upward with respect to the cleaning element together with the first sheet.

In a further aspect of the invention, fibers of the fiber element of the cleaning element may preferably extend in a direction transverse to the first direction across both of the first and second insert spaces. Thus, the fiber element is provided in which the fiber element is not separated into fibers on the first insert space side and fibers on the second insert space side.

In a further aspect of the invention, the intermediate bonding part may preferably be provided as a bonding part extending at least partially in a zigzag state. By this construction, the shape of the intermediate bonding part can be asymmetrical with respect to right and left sides in the first direction.

In a further aspect of the invention, a distance in the second direction between the insert opening of the first insert hole and the insert opening of the second insert hole may include a region narrower than the wider part. By such construction, guiding can be made to ease the insertion into respective insert holes.

In one embodiment, one side of the second sheet which faces away from the first sheet is defined as a first cleaning surface. This side of the second sheet is therefore exposed for cleaning: no other components are disposed on the first cleaning surface. This provides the cleaning element with an asymmetrical shape about the plane of the bonded first and second sheets, for example when considered in a direction orthogonal to the planar first and second sheets, such as shown in the cross-sectional views of FIGS. 4 and 5 below. This asymmetrical shape is also desirable when further components of the cleaning element are disposed on the side of the second sheet which faces away from the first sheet (this side of the second sheet no longer defining a first cleaning surface). It is preferred that the cleaning element is not symmetric about the plane of the bonded first and second sheets: in this respect, it does not have an equal number of layers disposed on either side of the plane of the bonded first and second sheets.

The fiber element may provide a second cleaning surface disposed on the opposite side of the cleaning element to the first cleaning surface. Alternatively, the fiber element may be sandwiched between the first sheet and a third sheet, the third sheet providing a second cleaning surface disposed on the opposite side of the cleaning element to the first cleaning surface.

In a preferred embodiment, the length of the side of the second sheet in the first direction is shorter than the length of the side of the first sheet in the first direction. Preferably, the length of the side of the second sheet in the second direction is substantially the same as the length of the side of the first sheet in the second direction.

As described above, according to this invention, a cleaning element for cleaning an object to be cleaned can collect dust, dirt or other objects to be collected into depths between the fibers, so that the cleaning effect can be enhanced. Other objects, features and advantages of the present invention will be readily understood after reading the following detailed description together with the accompanying drawings and the claims. In this respect, embodiments of the present invention will now be described, by way of example only, with reference to the accompanying diagrammatic drawings.

DETAILED DESCRIPTION OF THE INVENTION

Each of the additional features and method steps disclosed above and below may be utilized separately or in conjunction with other features and method steps to provide and manufacture improved cleaning tools and method for using such cleaning tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings. In this respect, the number of sheet layers and the number of fiber layers forming the cleaning element are independent of the configuration of the bonding parts when considered both in plan view and in cross-sectional view.

A structure of a cleaning tool 100 as one embodiment of a "cleaning tool" according to the invention is now explained with reference to the drawings. The cleaning tool 100 is configured as the cleaning tool which is used for cleaning an object to be cleaned. Objects to be cleaned typically include regions to be cleaned (floors, walls, windows, ceilings, external walls, posts, furniture, clothes, curtains, blinds, bedding, lighting, electrical cords, home electric appliances, etc.) inside and outside of houses, apartments, buildings, factories, vehicles (motor vehicles), etc. and regions of human body parts to be cleaned. These objects to be cleaned may have a planar structure or a three-dimensional structure. In this case, the regions to be cleaned may be either flat or curved, uneven or stepped.

Figure 1:
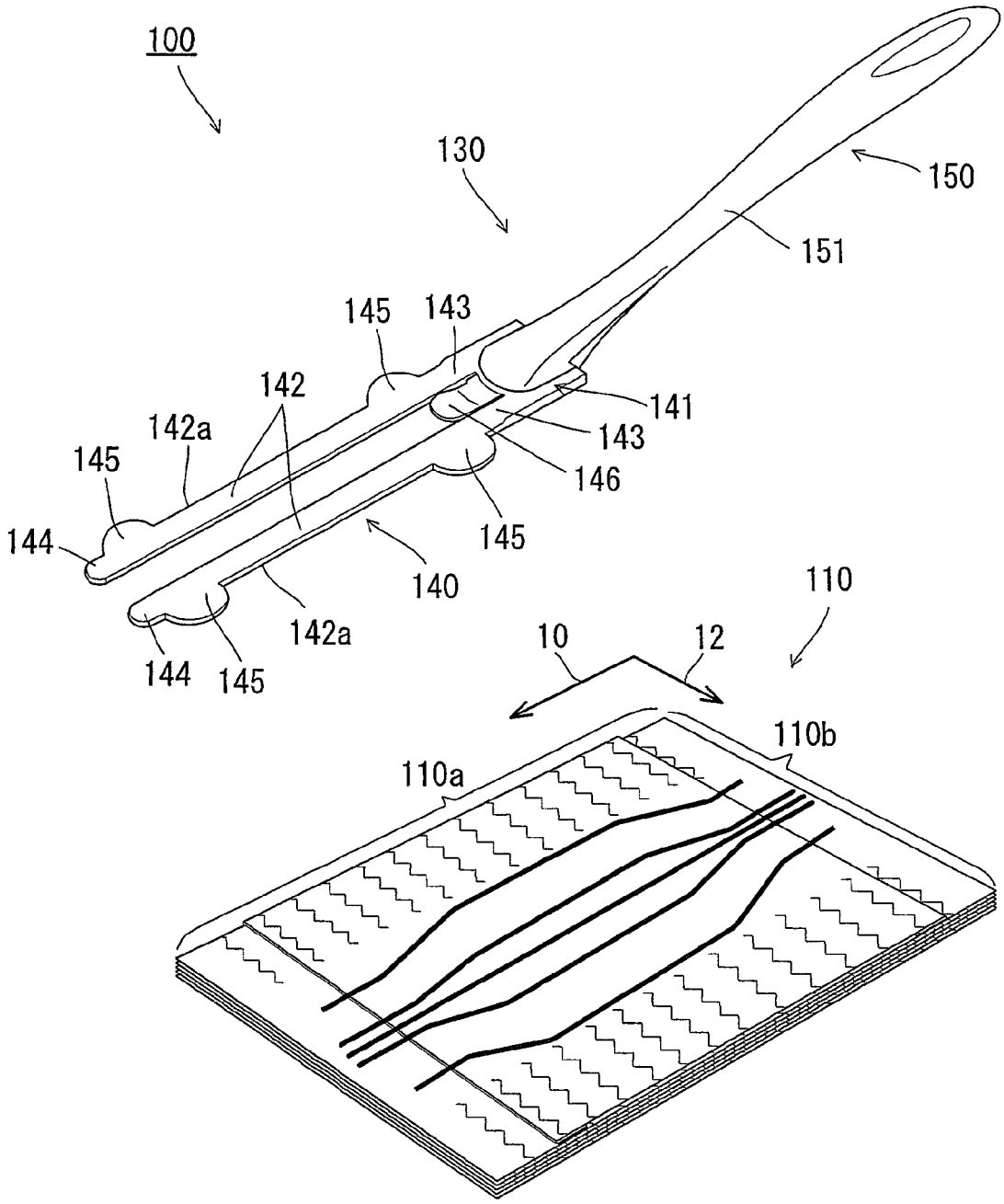
FIG. 1 is a perspective view showing components of a cleaning tool 100 according to this embodiment.

FIG. 1 shows components of the cleaning tool 100 according to this embodiment in perspective view. As shown in FIG. 1, the cleaning tool 100 comprises a cleaning element 110 and a cleaning element holder 130 for holding the cleaning element 110. The cleaning tool 100 is also referred to as a "mop".

The cleaning element 110 has a function of wiping, sweeping or scraping dust, dirt, contamination or other objects to be collected on an object to be cleaned. The cleaning element 110 is in a sheet-like or plate-like form at the time of purchase or in initial unused state, and in use, it is loosened such that its volume is increased in the direction of the sheet thickness. The cleaning element 110 is a rectangular sheet in plan view, extending in a predetermined longitudinal direction (a direction in which its long side extends), and has a layered structure in which a plurality of sheets (a holding sheet part 111 and a brush part 114 which are described below) having the same planar shape are overlaid one on the other, which is explained in more detail below. The cleaning element 110 herein is a feature that corresponds to the "cleaning element" according to this invention. In this embodiment, a first direction in which a long side 110*a* of the cleaning element 110 extends is shown by an arrow 10 in FIG. 1, and a second direction in which a short side 110*b* of the cleaning element 110 extends is shown by an arrow 12 in FIG. 1. The first direction 10 and the second direction 12 transverse to the first direction 10 are features that correspond to the "first direction" and the "second direction", respectively, according to this invention.

Further, the cleaning element 110 may also have a square, circular, elliptic, polygonal or other shape in a plan view as necessary. The cleaning element 110 having a rectangular or square shape in a plan view is designed such that its corners are right-angled or rounded as necessary. The cleaning element 110 may be of disposable type designed for single use, disposable type designed for multiple use which can be used several times, while holding the object to be collected, or reusable type which can be reused by washing.

The cleaning element holder 130 is removably attached to the cleaning element 110 constructed as described above. The cleaning element holder 130 is used for a cleaning operation with the cleaning element 110 attached thereto, and removed from the cleaning element holder 130 for storage or replacement of the cleaning element. The cleaning element holder 130 is an elongate member including the holder body 140 and the handle 150 connected to each other. Preferably, the cleaning element holder 130 typically comprises a nonmetallic material such as a synthetic resin material. The cleaning element holder 130 herein is a feature that corresponds to the "cleaning element holder" according to this invention The handle 150 includes a handle body 151 extending in an elongate form. The handle body 151 is a part to be held by user's hand. The holder body 140 is connected to the handle body 151 via a connection 141 which is formed by one end of the handle body 151 and one end of the holder body 140. This connecting structure of the handle 150 includes a structure in which the holder body 140 and the handle 150 (the handle body 151 and the connection 141) are separately formed and can be connected together, a structure in which the holder body 140 and the handle 150 are integrally formed together with the connection 141, a structure in which the connection 141 is integrally formed with one of the holder body 140 and the handle body 151. The handle 150 and the handle body 151 herein form the "grip" according to this invention.

The holder body 140 has a function of detachably holding the cleaning element 110. The holder body 140 includes a pair of right and left elongate holding elements 142. The holding elements 142 each have a fixed end 143 on the connection 141 side and a free end 144 on the opposite side, and extend in parallel (side by side) with a predetermined spacing therebetween on the same plane. In other words, the holder body 140 has a bifurcated front end portion formed by the holding elements 142. As for the sectional shape of the holding elements 142, rectangular, square, circular or polygonal shape can be appropriately used.

Each of the holding elements 142 has a protruding piece 145 and a retaining plate 146. The projection 145 protrudes outward from an outer edge 142*a* of the holding element 142. One or more (two in FIG. 1) protruding pieces 145 are preferably provided on each of the holding elements 142 in the longitudinal direction. With this construction, a region of the holding element 142 which has the protruding piece 145 forms a large-width portion having the largest extent in the width direction. The retaining plate 146 extends forward between the pair of holding plates 142 and is convexly curved downward. The retaining plate 146 further has an engagement lug (not shown) on the underside. The holding elements 142 herein form the "holding element" according to this invention.

Each of the holding elements 142 can be inserted into an associated insert space (an insert hole 117 which is described below) formed in the cleaning element 110 and has a function of holding the cleaning element 110 in the inserted state. In the inserted state, the holding elements 142 are fitted in the insert space of the cleaning element 110 by close sliding contact, so that the cleaning element 110 is securely attached to the holding elements 142. Further, in the inserted state, the large-width portions or the protruding pieces 145 of the holding elements 142 serve as a stopper for preventing the cleaning element 110 from coming off. Further, in the inserted state, the retaining plate 146 presses the cleaning element 110 from above, and the engagement lug formed on the underside of the retaining plate 146 serves as a stopper for preventing the cleaning element 110 from coming off. Thus, in the inserted state of the holding elements 142, the cleaning element 110 is reliably retained as being prevented from coming off by the holder body 140.

In order to realize smooth insertion of the holding element 142, preferably, the shape of the holding element 142 is appropriately selected. For example, the holding element 142 can be shaped in the width direction such that it has a constant width between the fixed end 143 and the free end 144, or such that it decreases in width toward the free end 144. Moreover, the holding element 142 can be shaped in the thickness direction such that it has a constant thickness between the fixed end 143 and the free end 144, or such that it decreases in thickness toward the free end 144.

Figure 2:
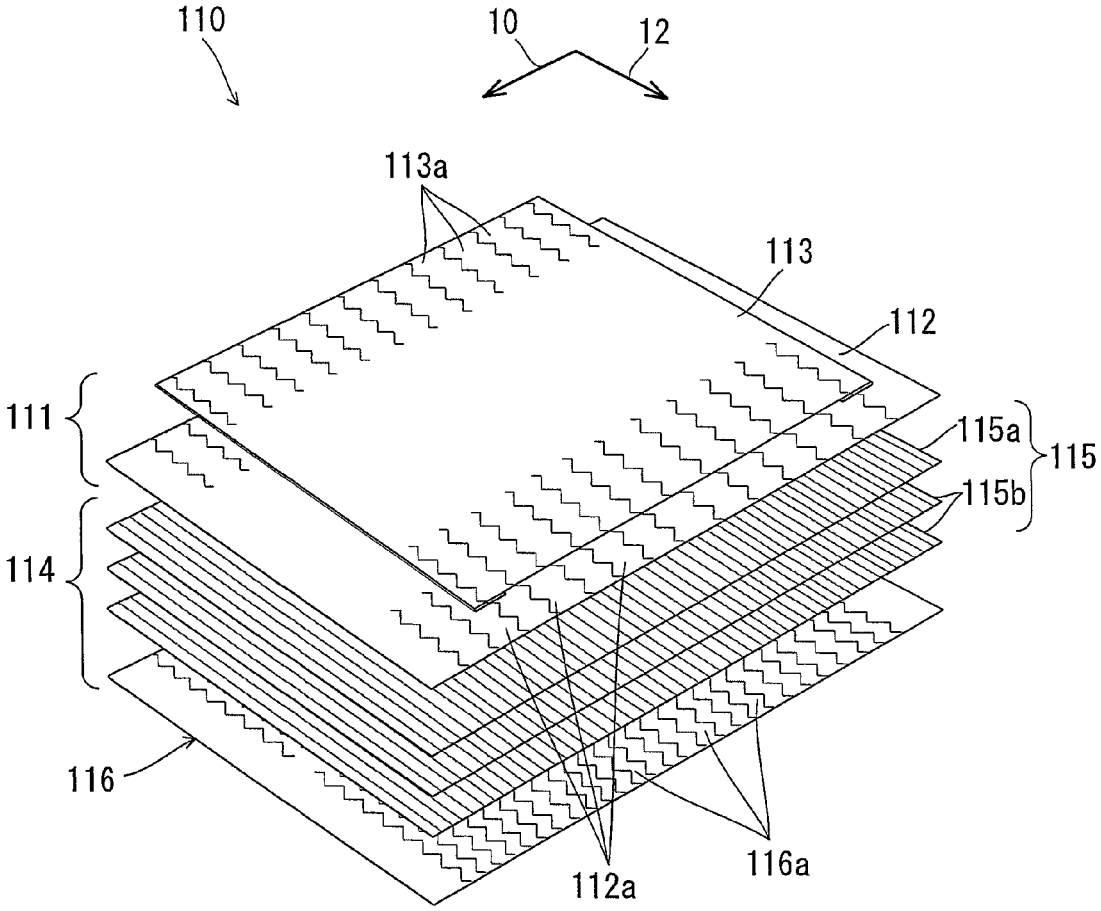
FIG. 2 is a perspective view of a cleaning element 110 in FIG. 1, in a state separated into elements of a layered structure.
Figure 3:
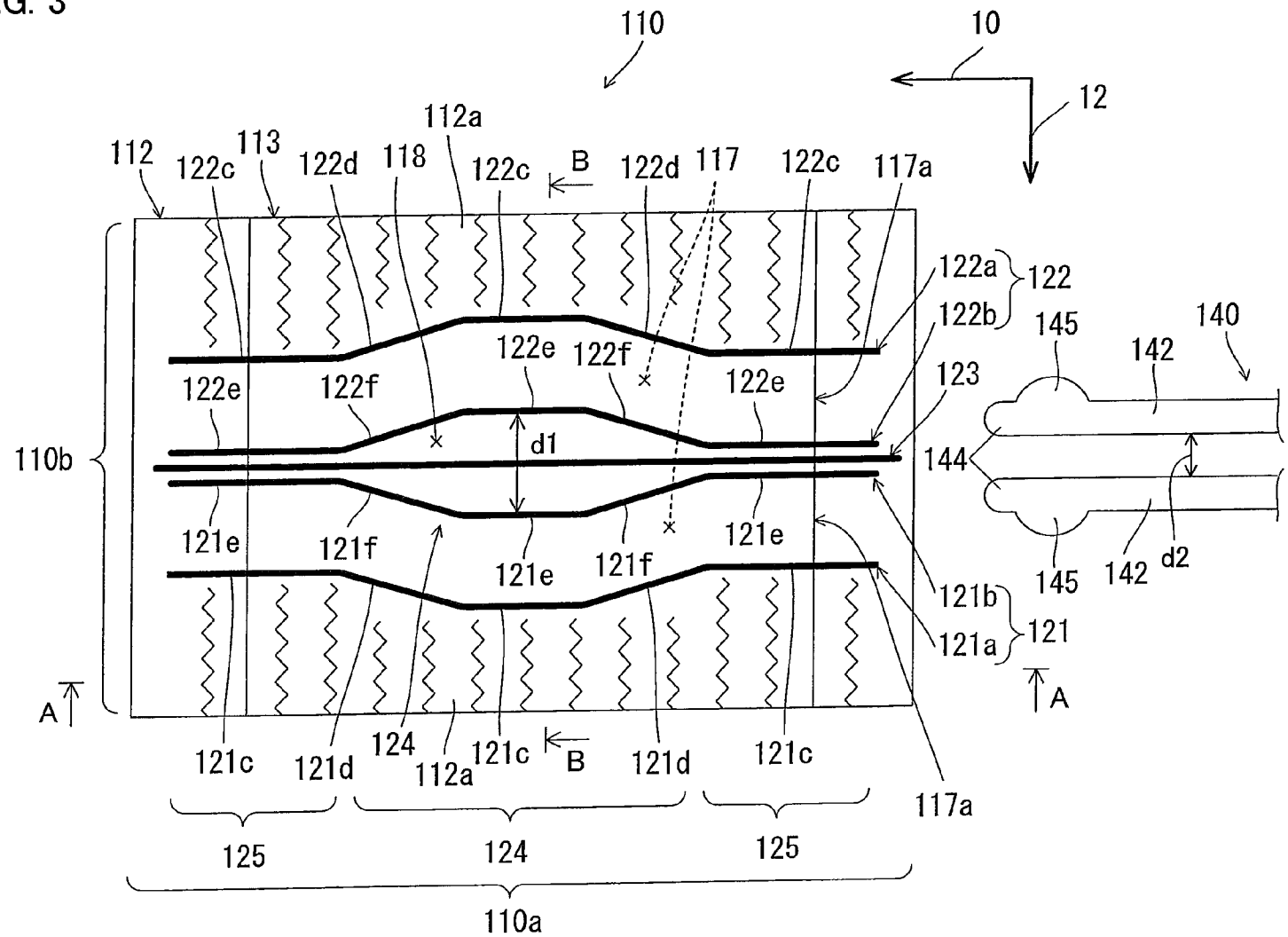
FIG. 3 is a plan view of the cleaning element 110 of FIG. 1.
Figure 4:
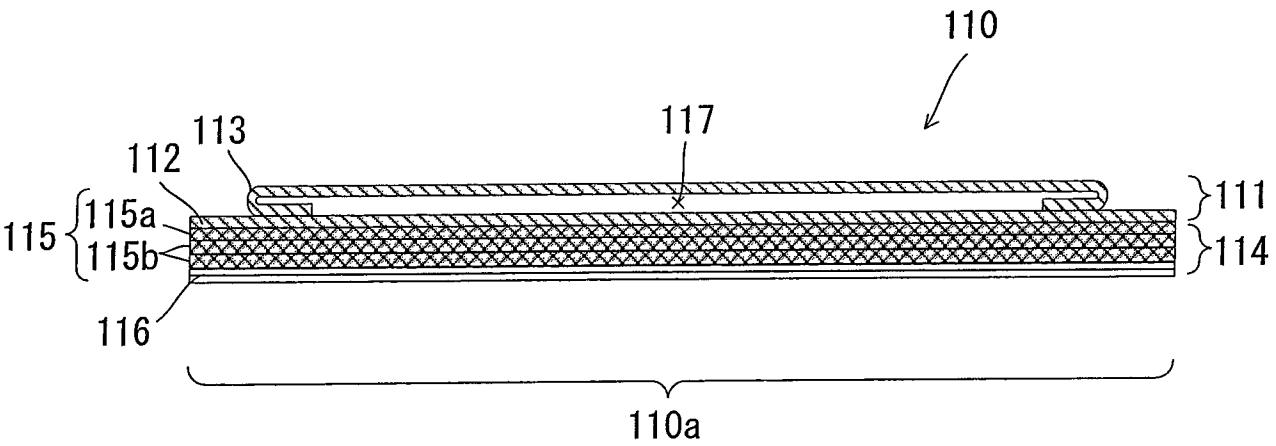
FIG. 4 is a sectional view of the cleaning element 110, taken along line A-A in FIG. 3.
Figure 5:
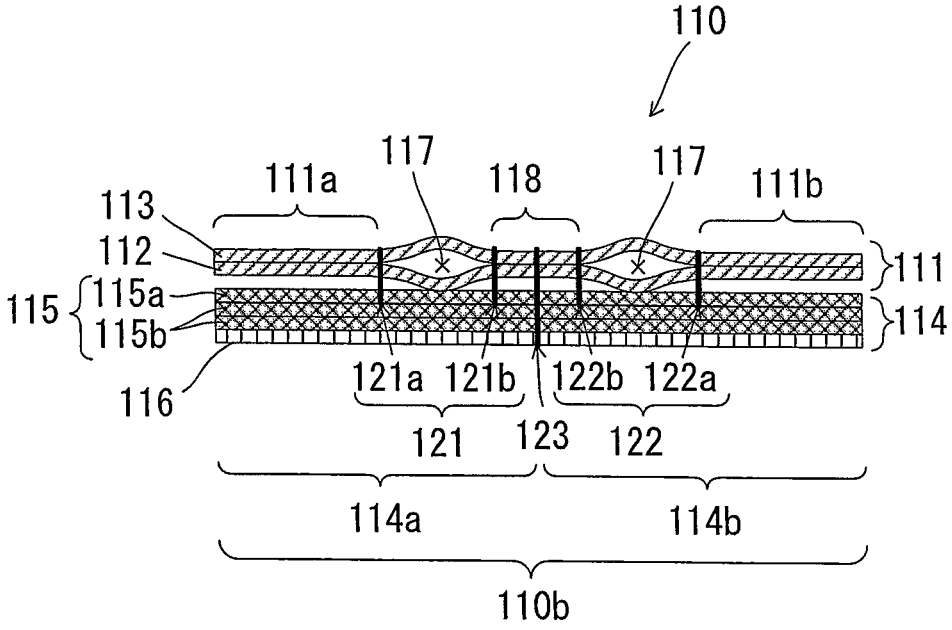
FIG. 5 is a sectional view of the cleaning element 110, taken along line B-B in FIG. 3.

The specific structure of the above-described cleaning element 110 is now explained in more detail with reference to FIGS. 2 to 5 in addition to FIG. 1. FIG. 2 is a perspective view of the cleaning element 110 of FIG. 1 which is shown separated into elements of a layered structure. FIG. 3 is a plan view of the cleaning element 110 of FIG. 1. FIG. 4 is a sectional view of the cleaning element 110, taken along line A-A in FIG. 3, and FIG. 5 is a sectional view of the cleaning element 110, taken along line B-B in FIG. 3.

As shown in FIG. 2, the cleaning element 110 of this embodiment includes a sheet-like holding sheet part 111 and the brush part 114. The brush part 114 is overlaid on one side of the holding sheet part 111 and bonded together at predetermined bonding locations.

As shown in FIG. 4, the holding sheet part 111 includes a first sheet 112 and a second sheet 113 which are formed of nonwoven fabric and overlaid one on the other. The holding sheet part 111 is preferably constructed such that the long side of the second sheet 113 in the first direction 10 is shorter than the long side of the first sheet 112 in the first direction 10. With this construction, in the state in which the first sheet 112 and the second sheet 113 are overlaid one on the other, a protruding surface of the first sheet 112 which protrudes from the second sheet 113 serves to smoothly guide the holding elements 142 of the cleaning element holder 130 into insert holes 117 which are described below. The first sheet 112 and the second sheet 113 here are features that correspond to the "first sheet" and the "second sheet", respectively, according to this invention.

The brush part 114 includes a fiber assembly 115 and a nonwoven fabric third sheet 116 which are overlaid one on the other, and is laid over the first sheet 112 of the holding sheet part 111 with the fiber assembly 115 facing it. Thus, the cleaning element 110 is provided such that the fiber assembly 115 is disposed between the first sheet 112 of the holding sheet part 111 and the third sheet 116. The fiber assembly 115 includes three fiber elements which are stacked in layer. One of the three fiber elements is a fiber element 115*a* which is arranged on the first sheet 112 side and formed of a plurality of fibers of a first group ("a plurality of fibers of a first group" according to this invention), and the other two fiber elements are fiber elements 115*b* formed of a plurality of fibers of a second group ("a plurality of fibers of a second group" according to this invention). The fibers of the fiber elements 115*a*, 115*b* of the fiber assembly 115 extend in the second direction 12 across both of the two insert holes. Therefore, the cleaning element is provided in which the fiber assembly 115 is not separated into fibers assigned to one of the insert holes 117 and fibers assigned to the other insert hole 117. Further, in this cleaning element 110, the second sheet 113 of the holding sheet part 111 forms one of the cleaning element surfaces (cleaning element upper side), and the third sheet 116 of the brush part 114 forms the other cleaning element surface (cleaning element lower side). Thus, in the cleaning element 110, one side of the second sheet 113 is exposed on the one cleaning element surface, and one side of the third sheet 116 is exposed on the other cleaning element surface.

Preferably, the first sheet 112, the second sheet 113 and the third sheet 116 which are described above have a plurality of respective zigzag strips (strip portions) 112*a*, 113*a*, 116*a* at their right and left ends in the direction of the arrow 12 in FIG. 2. Each of the strips 112*a*, 113*a*, 116*a* extends elongate in the direction of the arrow 12 in FIG. 2. In this case, the sheets 112, 113, 116 are also referred to as strip sheets. The strips having such construction are provided with a highly effective cleaning function which can easily trap dust or scrape dust out of a depression. Further, the strips 112*a*, 113*a*, 116*a* may have the same kind or different kinds of shape appropriately selected from various shapes, such as zigzag, linear and curved shapes.

(Construction of Nonwoven Fabric)

The first sheet 112, the second sheet 113 and the third sheet 116 which are described above can typically be formed of sheet-like nonwoven fabric comprising thermal melting fibers (thermoplastic fibers). Therefore, the first sheet 112, the second sheet 113 and the third sheet 116 are also referred to as the "nonwoven fabric sheet". The nonwoven fabric has a sheet-like configuration formed by fixing or intertwining fibers by mechanical, chemical or heat treatment. The nonwoven fabric partly includes thermoplastic fibers and thus can be fusion bonded. Further, the nonwoven fabric has a plurality of strips. Examples of the thermal melting fibers (thermoplastic fibers) include polyethylene, polypropylene and polyethylene terephthalate.

Further, the nonwoven fabric preferably comprises thermoplastic fibers having practical strength of 10 to 100 g/m$^2$. The nonwoven fabric may be manufactured by through-air bonding, spun bonding, thermal bonding, spun lacing, point bonding, melt blowing, stitch bonding, chemical bonding, needle punching or other similar processes. This nonwoven fabric is a feature that corresponds to the "nonwoven fabric" according to this invention. In order to enhance the sweeping-out function, it is preferred to use a nonwoven fabric having higher rigidity. Further, as an alternative to or in addition to the nonwoven fabric, strips made of urethane, sponge, woven fabric, net, split cloth or other similar materials may be used.

(Construction of Fiber Assembly)

Each of the fiber elements 115*a*, 115*b* of the fiber assembly 115 may be a single fiber structure formed by fibers, a fiber structure having fibers aligned in the length direction and/or the radial direction (twist yarn, spun yarn, yarn to which a plurality of filaments are partially connected), or an assembly of the fiber structures. Each of the fiber elements 115*a*, 115*b* partially includes thermoplastic fibers and can be bonded. The fibers forming each of the fiber elements are elements of yarn, textile or the like and defined as being thin and flexible fibers having a substantially longer length compared with the thickness. Typically, a long continuous fiber is defined as a filament and a short fiber as a staple. Like the strips 112*a*, 113*a*, 116*a*, the fibers of the fiber elements extend in elongate form in the direction of the arrow 12 in FIG. 2. The fiber assembly 115 is also referred to as the "fiber bundle" having a plurality of fibers in a bundle. The fiber elements 115*a*, 115*b* of the fiber assembly 115 forms the "fiber elements" according to this invention.

Further, in this embodiment, the fiber assembly 115 is formed by the fiber elements 115*a*, 115*b* stacked in layers, but one or more fiber elements may be used as necessary. Preferably, the fiber assembly 115 or the fiber elements 115*a*, 115*b* have a planar structure having a predetermined flat or curved surface and has a three-dimensional form having a certain thickness or has a thin sheet-like form. The "fiber element" here is typically formed of polyethylene (PE), polypropylene (PP), polyethylene terephthalate (PET), nylon, rayon or the like. In practical use, an assembly of filaments formed by opening a tow is frequently used as the fiber element. It is particularly preferable that the fiber element comprises conjugated fibers having a core of polypropylene (PP) or polyethylene terephthalate (PET) and a core covering sheath of polyethylene (PE). Further, the filaments of the fiber element are preferred to have a fineness of 0.5 to 66 dtex. The fiber element may contain fibers of substantially the same fineness, or it may contain fibers of different finenesses. When using fibers containing thermoplastic resin, it is preferred to use at least two or more kinds of resins having different melting points (for example, resins between which the difference in the melting point is 20° C. or more).

Further, in order to enhance the sweeping-out function, it is preferred to use a fiber element including fibers having higher rigidity or fibers having higher fineness. It is further preferred that the fiber element has crimped fibers. In this case, it is preferred to use crimped fibers having 5 to 30 crimps per inch. Here, the crimped fibers are fibers subjected to a predetermined crimping process and easily intertwined with each other. With the fibers being crimped, the fiber element becomes bulkier than before the cleaning element holder is attached thereto, and dust can be easily captured by the crimped portions. This structure can be realized especially by using crimped fibers opened from a tow. Further, in order to reliably adsorb dirt, dust or the like, it is preferred to use fibers containing dust adsorbent oil.

For the fiber element, flat yarns or split yarns may also be used. The flat yarns are prepared by slitting a film into tapes and by stretching the tapes in the longitudinal direction. The split yarns are prepared by splitting a thermoplastic film resin in the direction perpendicular to the orientation direction of the resin so that the film is fibrillated and interconnected into a net shape. Alternatively, a nonwoven fabric which is bulky and has low fiber density, such as a through-air bonded nonwoven fabric, may be used to form the fiber element.

As shown in FIG. 3, the cleaning element 110 as described above has a first bonding part 121, a second bonding part 122 and a third bonding part 123 which extend in the first direction 10 in which the long side 110*a* of the cleaning element 110 extend. Each of the first bonding part 121, the second bonding part 122 and the third bonding part 123 is preferably formed by using at least one of fusion bonding, gluing, fastening, seaming and other similar joining methods. The third bonding part 123 forms a continuous bonding line and is arranged in a central region of the cleaning element 110, the central region being in the second direction 12 in which the short side 110*b* of the cleaning element 110 extends. The first bonding part 121 and the second bonding part 122 are arranged on both sides of the third bonding part 123. In the embodiment shown in FIG. 3, the first bonding part 121 and the second bonding part 122 are arranged at the same distance from the third bonding part 123 in the second direction 12 and formed in symmetry with respect to the third bonding part 123.

The first bonding part 121 includes a first outer bonding part 121*a* and a first inner bonding part 121*b* which extend side by side, and the first inner bonding part 121*b* is arranged close to the second bonding part 122. The first outer bonding part 121*a* and the first inner bonding part 121*b* of the first bonding part 121 may be parallel or may not be parallel to each other. The first outer bonding part 121*a* and the first inner bonding part 121*b* here are features that correspond to the "first outer bonding part" and the "first inner bonding part", respectively, according to this invention. It is noted that the exemplified arrangements of these bonding parts are not to be limited to the specific layered structure of the cleaning element shown in FIG. 2.

Similarly, the second bonding part 122 includes a second outer bonding part 122*a* and a second inner bonding part 122*b* which extend side by side, and the second inner bonding part 122*b* is arranged close to the first bonding part 121. The second outer bonding part 122*a* and the second inner bonding part 122*b* of the second bonding part 122 may be parallel or may not be parallel to each other. The second outer bonding part 122*a* and the second inner bonding part 122*b* here are features that correspond to the "second outer bonding part" and the "second inner bonding part", respectively, according to this invention. Further, the "inner bonding part" refers to one of a plurality of bonding parts forming the first bonding part 121 (the second bonding part 122) which faces the second bonding part 122 (the first bonding part 121), and the "outer bonding part" refers to one of bonding parts forming the first bonding part 121 (the second bonding part 122) which faces away from the second bonding part 122 (the first bonding part 121).

The first inner bonding part 121*b* of the first bonding part 121 and the second inner bonding part 122*b* of the second bonding part 122 define an intermediate region 118. The third bonding part 123 is arranged in the intermediate region 118. In this case, the third bonding part 123 may be separately formed from the first bonding part 121 and the second bonding part 122, or it may be formed to serve as part of the first bonding part 121 or the second bonding part 122. The intermediate region 118 and the third bonding part 123 arranged in the intermediate region 118 here are features that correspond to the "intermediate region" and the "intermediate bonding part", respectively, according to this invention.

The first outer bonding part 121*a* is configured as a continuously extending bonding line which has three straight regions 121*c* extending straight in the first direction 10 and spaced apart from each other and two oblique regions 121*d* obliquely disposed between two adjacent straight regions 121*c*. Further, the first inner bonding part 121*b* is configured as a continuously extending bonding line which has three straight regions 121*e* extending straight in the first direction 10 and spaced apart from each other and two oblique regions 121*f* obliquely disposed between two adjacent straight regions 121*e*. Similarly, the second outer bonding part 122*a* is configured as a continuously extending bonding line which has three straight regions 122*c* extending straight in the first direction 10 and spaced apart from each other and two oblique regions 122*d* obliquely disposed between two adjacent straight regions 122*c*. Further, the second inner bonding part 122*b* is configured as a continuously extending bonding line which has three straight regions 122*e* extending straight in the first direction 10 and spaced apart from each other and two oblique regions 122*f* obliquely disposed between two adjacent straight regions 122*e*.

Further, each of the first bonding part 121, the second bonding part 122 and the third bonding part 123 may be formed by a bonding line or a bonding point which continuously extends in the first direction 10, or by a plurality of bonding lines or bonding points which discontinuously extend in the first direction 10. Further, the bonding lines may have various forms such as straight, broken, wiggly, zigzag and curved lines, either in part or as a whole.

A region which is defined by the first and second sheets 112, 113 overlaid one on the other and the first bonding part 121 is formed as one of the insert holes 117 which receives one of the holding elements 142 of the cleaning element holder 130. Similarly, a region which is defined by the first and second sheets 112, 113 overlaid one on the other and the second bonding part 122 is formed as the other insert hole 117 which receives the other holding element 142 of the cleaning element holder 130. Each of the insert holes 117 is formed as an insert space extending from an insert opening 117*a* in the first direction 10 in which the long side 110*a* of the cleaning element 110 extends. The insert hole 117 typically extends in a straight, curved or wiggly line. In place of the insert hole 117, an insert space other than an insert hole such as a slit and a cut into which the holding element 142 can be inserted may also be provided. Further, the insert hole 117 can be formed as an insert space in which its extending direction coincides or nearly coincides with the first direction 10 in its entirety or in part. The insert holes 117 form the "first insert space" and the "second insert space" according to this invention.

Referring to FIG. 5, specific bonding areas of the cleaning element 110 which are bonded by the above-described first, second and third bonding parts 121, 122, 123 are now described. As shown in FIG. 5, each of the first and second bonding parts 121, 122 is formed as a bonding part in which the holding sheet part 111 and part of the brush part 114, or specifically, the first and second sheets 112, 113 and the fiber element 115*a* which form three of the cleaning element components, are bonded together. Thus, in the fiber elements of the fiber assembly 115, only the fiber element 115*a* formed of a plurality of fibers of the first group is connected to the holding sheet part 111 in the first and second bonding parts 121, 122, and the fiber element 115*b* formed of a plurality of fibers of the second group is not connected to the holding sheet part 111 in the first and second bonding parts 121, 122. On the other hand, the third bonding part 123 is formed as a bonding part for bonding the holding sheet part 111 and the brush part 114 in their entirety.

By such bonding, each of the holding sheet part 111 (the first and second sheets 112, 113) and the fiber element 115*a* has a first extending portion 111*a* and a second extending portion 111*b*. The first extending portion 111*a* has a fixed end in the form of an end bonded at the first outer bonding part 121*a* and a free end on the opposite side of the first outer bonding part 121*a* from the first inner bonding part 121*b*. The second extending portion 111*b* has a fixed end in the form of an end bonded at the second outer bonding part 122*a* and a free end on the opposite side of the second outer bonding part 122*a* from the second inner bonding part 122*b*. Further, part of the brush part 114 excluding the fiber element 115*a*, i.e. the fiber elements 115*b* and the third sheet 116, each have a first extending portion 114*a* and a second extending portion 114*b*. Each of the first and second extending portions 114*a*, 114*b* has a fixed end bonded at the third bonding part 123 and a free end remote from the third bonding part 123.

The cleaning element 110 of this embodiment has a feature that it has a wider part 124 in which the intermediate region 118 has a width or distance d1 in the second direction 12 which is longer than a shortest distance d2 between the two holding elements 142 in the state in which the cleaning element holder 130 is not attached to the cleaning element 110, or in the state in which the holding elements 142 are not completely inserted into the insert holes 117. The wider part 124 may be formed along the entire length of the cleaning element 110 in the first direction 10, or it may be formed in part of the cleaning element 110 along the first direction 10. In the embodiment shown in FIG. 3, the distance d2 between the two holding elements 142 is constant in the first direction 10. Further, narrower parts 125 are provided on both sides of the wider part 124 in the first direction 10. In each of the narrower parts 125, the width or distance between the insert holes 117 in the second direction 12 is shorter than in the wider part 124, or specifically the distance d1 is shorter than the distance d2. Particularly, the narrower part 125 on the insert opening 117*a* side serves as a guiding region for facilitating insertion of the holding elements 142 into the insert holes 117. The wider part 124 and the narrower parts 125 are features that correspond to the "wider part" and the "narrower parts", respectively, according to this invention.

Figure 6:
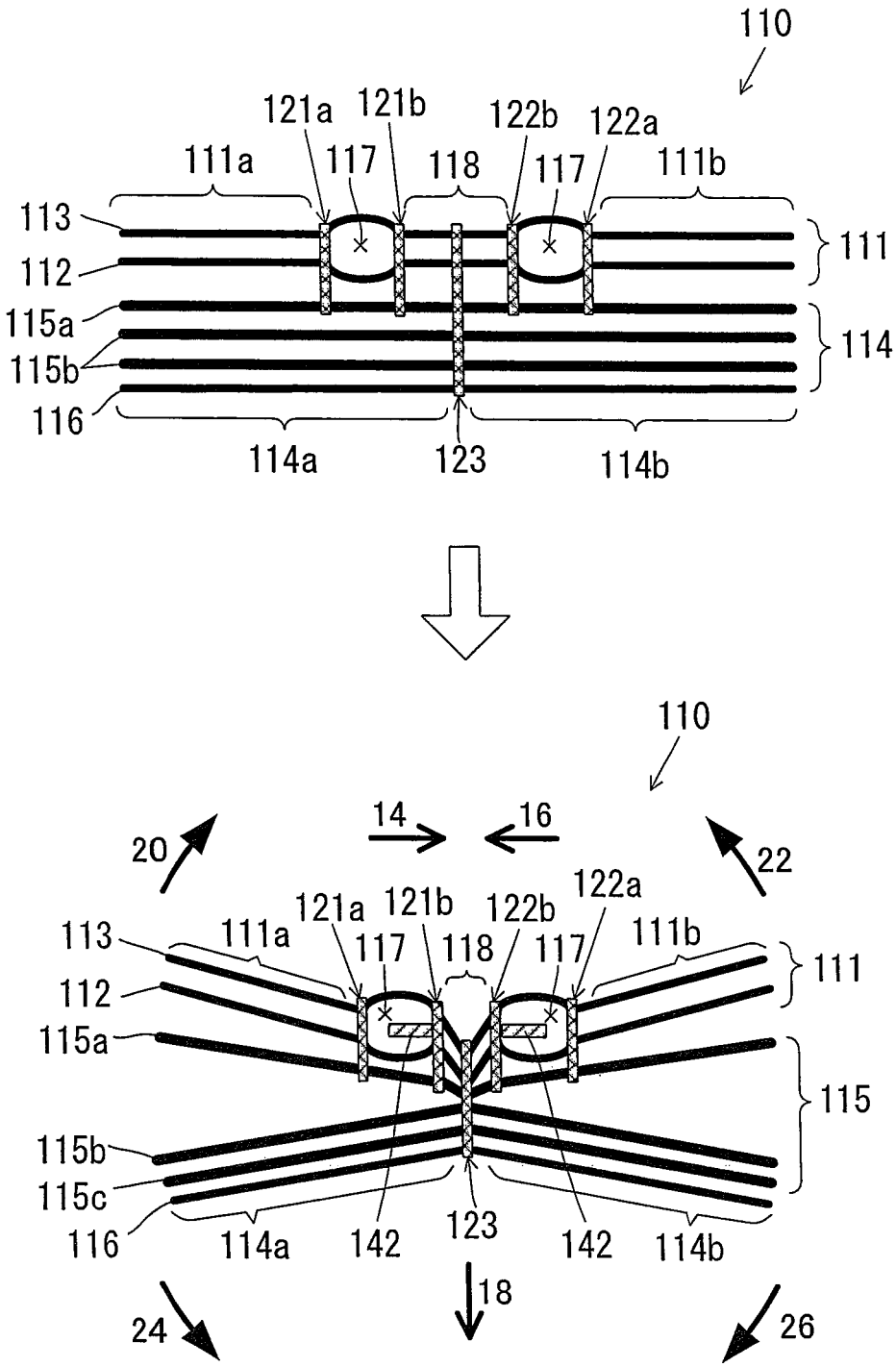
FIG. 6 shows the sectional structure of the cleaning element 110 shown in FIG. 5 before and after insertion of holding elements 142 into insert holes 117.

The effect of the cleaning element 110 having the above-described wider part 124 is now described with reference to FIG. 6 in addition to FIG. 3. FIG. 6 shows the sectional structure of the cleaning element 110 shown in FIG. 5 before and after insertion of the holding elements 142 into the insert holes 117.

In FIG. 3, when the holding elements 142 are inserted into the insert holes 117, first, the free end 144 of the one holding element 142 comes in contact with one of the oblique regions 121*f* which is located closer to the insert opening 117*a* in the first inner bonding part 121*b*, while the free end 144 of the other holding element 142 comes in contact with one of the oblique regions 122*f* which is located closer to the insert opening 117*a* in the second inner bonding part 122*b*. When the holding elements 142 are further inserted, the oblique regions 121*f*, 122*f* are moved toward each other by the holding elements 142, and middle straight regions 121*e*, 122*e* contiguous to the oblique regions 121*f*, 122*f* are also moved toward each other by the holding elements 142.

As a result, as shown in FIG. 6, the two insert holes 117 are moved toward each other in the directions of arrows 14, 16 in the drawing, so that the holding sheet part 111 and the fiber element 115*a* in the intermediate region 118 are pushed out in a direction in which the fiber assembly 115 is located with respect to the insert holes 117, or in the direction of an arrow 18 in the drawing. By this push, fiber portions of the fiber assembly 115 on the both sides of the intermediate region 118 (for example, free ends of the fiber assembly 115 having a fixed end formed by the intermediate region 118) increase in thickness. Specifically, the free ends of the first extending portions 111*a* of the holding sheet part 111 and the fiber element 115*a* swing on the third bonding part 123 around the intermediate region 118 in the direction of the arrow 20, while the free ends of the second extending portions 111*b* of the holding sheet part 111 and the fiber element 115*a* swing on the third bonding part 123 around the intermediate region 118 in the direction of the arrow 22. Further, when the protruding pieces 145 of each of the holding elements 142 slide on the first outer bonding part 121*a* or the second outer bonding part 122*a*, the swinging movement of the first and second extending portions 111*a*, 111*b* is further facilitated. In order to secure more reliable swinging movement, in the section of the cleaning element 110 in the width direction (in the second direction 12 in FIG. 3), preferably, components disposed on the upper and lower sides of the holding sheet part 111 are asymmetrically shaped with respect to the holding sheet part 111. In the embodiment shown in FIG. 6, the cleaning element 110 has no component on the upper side of the holding sheet part 111, so that it is asymmetrical with respect to the holding sheet part 111.

Further, during swinging movement of the first and second extending portions 111*a*, 111*b*, the first extending portions 114*a* of the third sheet 116 and the fiber elements 115*b* and the second extending portions 114*b* of the third sheet 116 and the fiber elements 115*b* are substantially held unchanged in position, or the free ends of the fiber elements swing by their own weight on the third bonding part 123 around the intermediate region 118 in the direction of the arrow 24 or the arrow 26.

By the above-described swinging movement of the first and second extending portions 111*a*, 111*b*, in the section of the cleaning element 110 in the width direction (in the direction of the arrow 12 in FIG. 3), the distances between fibers of the fiber assembly 115 in the above-described pushing-out direction are increased, so that the apparent specific volume of the fiber assembly 115 can be increased compared with that of the cleaning element 110 to which the cleaning element holder 130 is not attached. As a result, a region for collecting dust, dirt or other objects to be collected can be extended down to the depths between the fibers. Therefore, the fiber assembly 115 can be effectively used, so that the cleaning effect can be enhanced.

Further, the surface area of the fiber assembly 115 can be increased by increase of the distances between the fibers of the fiber assembly 115. Therefore, the area of cleaning with one wipe is increased, so that the wiping effect is enhanced.

Further, the above-described increase of the specific volume and the surface area of the fiber assembly 115 can be automatically realized by inserting the holding elements 142 into the insert holes 117. Therefore, advantageously, it is not necessary for users to take the trouble to perform any operation for increasing the volume of the cleaning element 110 before use, for example, by loosening fibers of the fiber assembly 115 by hand or by shaking the cleaning element holder 130 with the cleaning element 110 attached thereto. Moreover, once the cleaning element 110 is given some shape, the shape is forcefully retained by the holding elements 142 inserted into the insert holes 117, so that the shape can be retained for a longer time with stability.

Other Embodiments

The invention is not limited to the above-described embodiment, but rather, may be added to, changed, replaced with alternatives or otherwise modified. For example, the following embodiments can also be performed in application of the above-described embodiment.

In this invention, the kind and number of components of the cleaning element 110 and the cleaning element holder 130 are not limited to those in the above-described embodiment, but they can be appropriately selected as necessary. For example, the cleaning element 110 may have three or more insert holes, and/or the cleaning element holder 130 may have three or more holding elements.

Further, in the above-described embodiment, the cleaning element 110 is formed by a sheet-like nonwoven fabric and fiber elements, but in this invention, the cleaning element 110 may be formed by either one of the sheet-like nonwoven fabric and the fiber elements.

In the cleaning element 110 of the above-described embodiment, the third sheet 116 formed of nonwoven fabric is included in the brush part 114, but the third sheet 116 can be omitted from the brush part 114, as necessary, for example, according to change of design specifications of the cleaning element 110.

Further, in the cleaning element 110 of the above-described embodiment, the holding sheet part 111 defines the upper surface of the cleaning element, or in other words, no components of the cleaning element is provided on the opposite side of the holding sheet part 111 from the brush part 114. In the invention, however, a brush part like the fiber assembly 115 can also be provided on the opposite side of the holding sheet part 111 from the brush part 114.

Further, in this invention, the shape and arrangement of the first, second and third bonding parts 121, 122, 123 are not limited to those of the cleaning element 110 in the embodiment shown in FIG. 3, but can be appropriately changed as necessary. For example, cleaning elements 210, 220, 230, 240, 250, 260, 270 of other embodiments shown in plan view in FIGS. 7 to 13 can also be applied. The exemplified arrangements of the bonding parts in these other embodiments are not to be limited to the specific layered structure of the cleaning element shown in FIG. 2.

Figure 7:
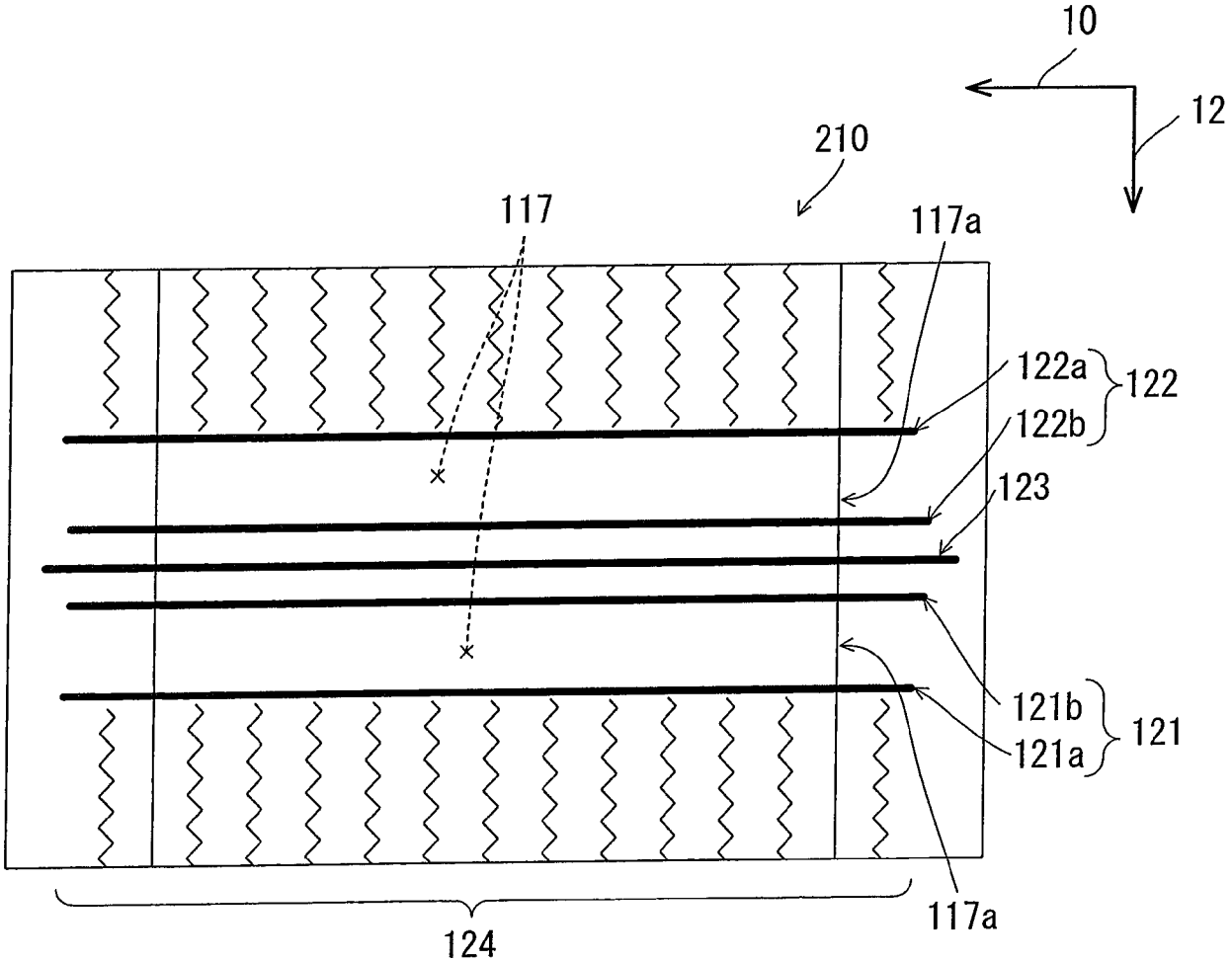
FIG. 7 is a plan view of a cleaning element 210 of a different embodiment.

In the cleaning element 210 shown in FIG. 7, the first outer bonding part 121*a* and the first inner bonding part 121*b* of the first bonding part 121 extend in parallel to each other in the first direction 10 and in parallel to the third bonding part 123. Similarly, the second outer bonding part 122*a* and the second inner bonding part 122*b* of the second bonding part 122 extend in parallel to each other in the first direction 10 and in parallel to the third bonding part 123. Therefore, unlike the cleaning element 110 shown in FIG. 3, the wider part 124 is provided along the entire length of the first and second bonding parts 121, 122, and the narrower part 125 is not provided. Further, in this embodiment, each of the insert holes 117 is formed as an insert space extending straight in the first direction 10 in its entirety.

Figure 8:
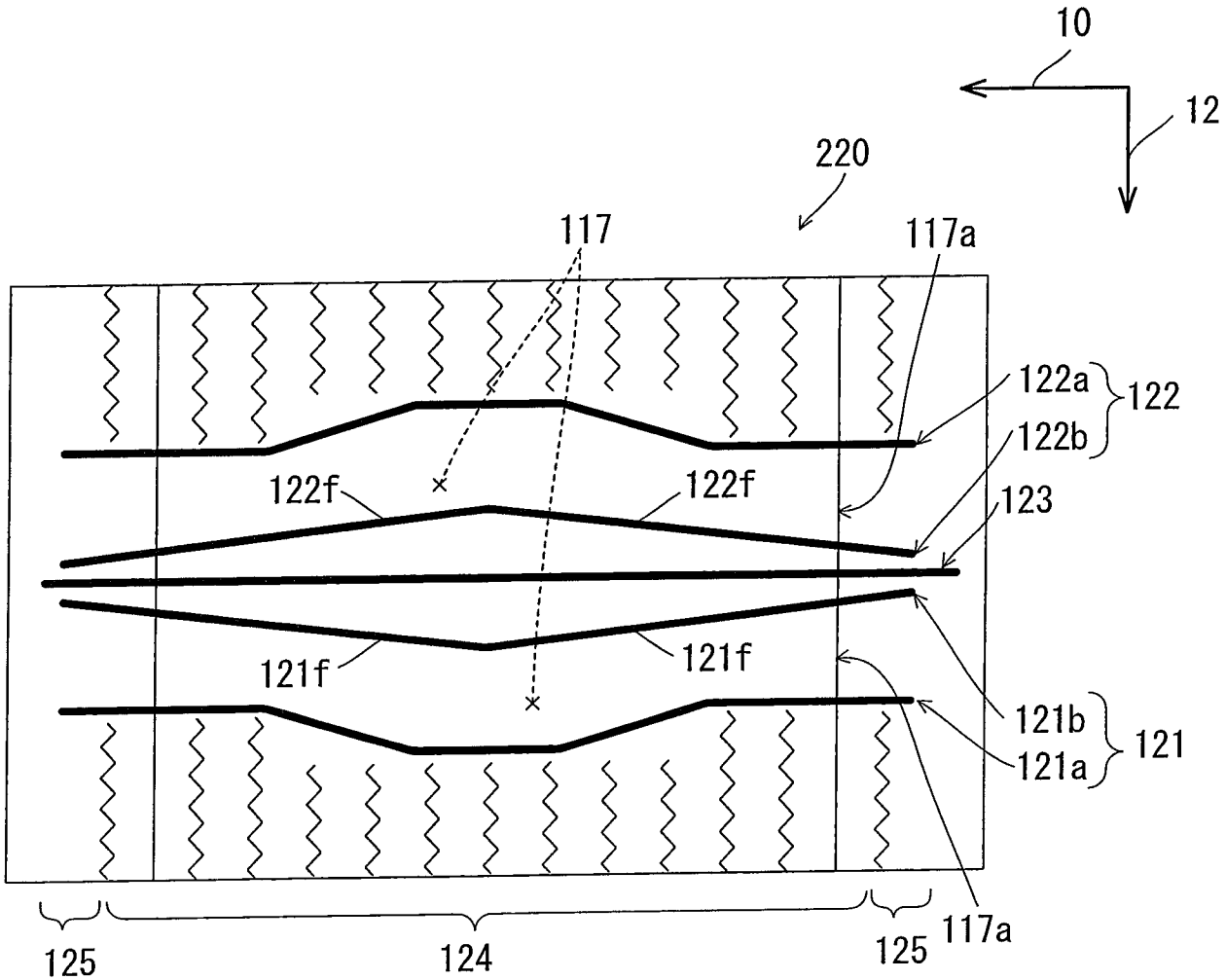
FIG. 8 is a plan view of a cleaning element 220 of a different embodiment.

The cleaning element 220 shown in FIG. 8 has the same bonding parts as the cleaning element 110 shown in FIG. 3, except for the first inner bonding part 121*b* of the first bonding part 121 and the second inner bonding part 122*b* of the second bonding part 122. The first inner bonding part 121*b* is formed only by two oblique regions 121*f* and does not have the straight region 121*e* shown in FIG. 3. Similarly, the second inner bonding part 122*b* is formed only by two oblique regions 122*f* and does not have the straight region 122*e* shown in FIG. 3. Further, in this embodiment, each of the insert holes 117 is formed as an insert space extending straight in the first direction 10 in part and extending in the first direction as a whole.

Figure 9:
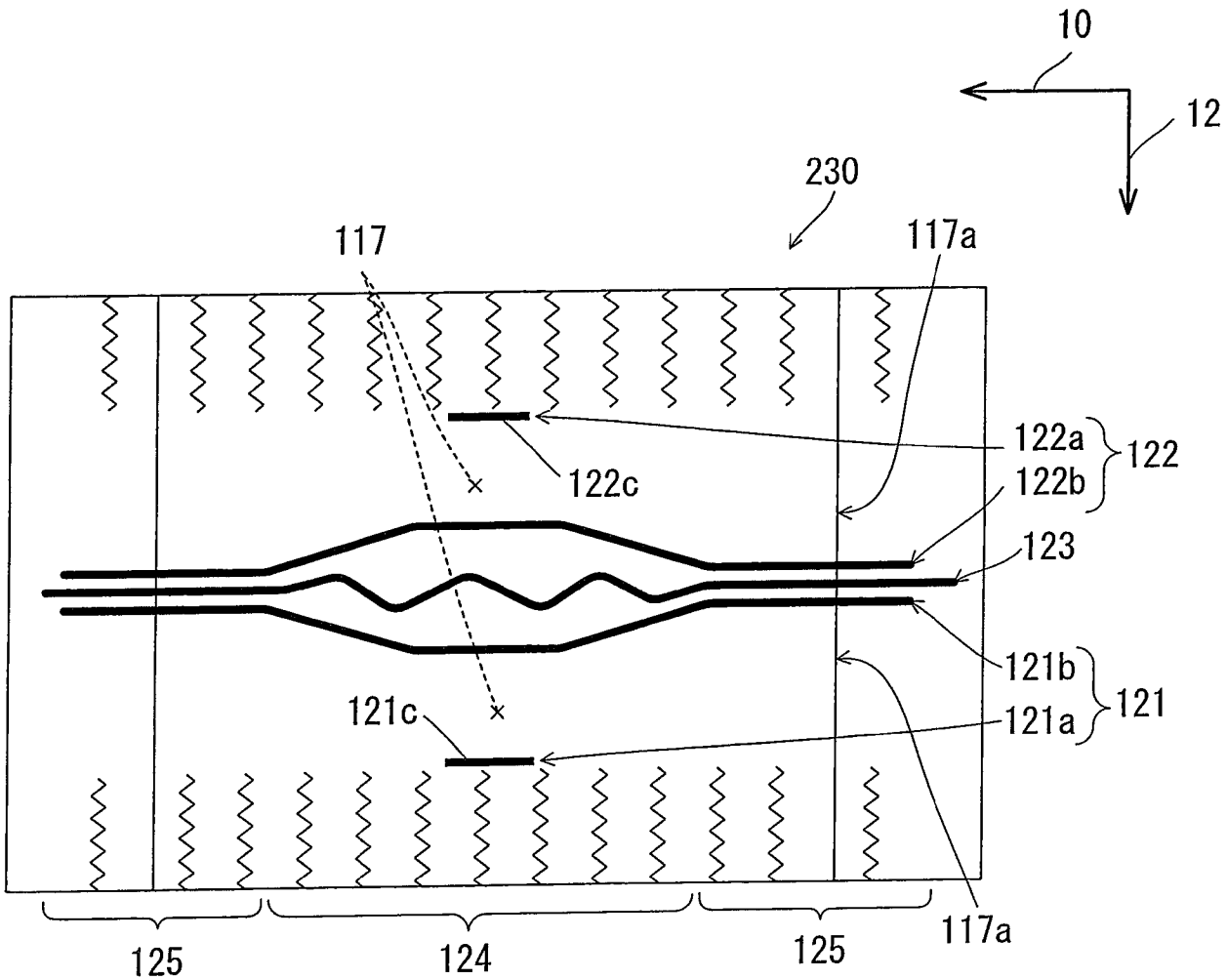
FIG. 9 is a plan view of a cleaning element 230 of a different embodiment.

In the cleaning element 230 shown in FIG. 9, the third bonding part 123 is a bonding line formed by a zigzag line extending in the first direction 10 and having straight lines on both ends of the zigzag line. Thus the third bonding part 123 is asymmetrically shaped in the first direction 10. Further, the first outer bonding part 121*a* of the first bonding part 121 is formed only by the middle straight region 121*c* of the cleaning element 110 shown in FIG. 3. Similarly, the second outer bonding part 122*a* of the second bonding part 122 is formed only by the middle straight region 122*c* of the cleaning element 110 shown in FIG. 3. Further, in this embodiment, each of the insert holes 117 is formed as an insert space extending straight in the first direction 10 in part and extending in the first direction 10 as a whole.

Figure 10:
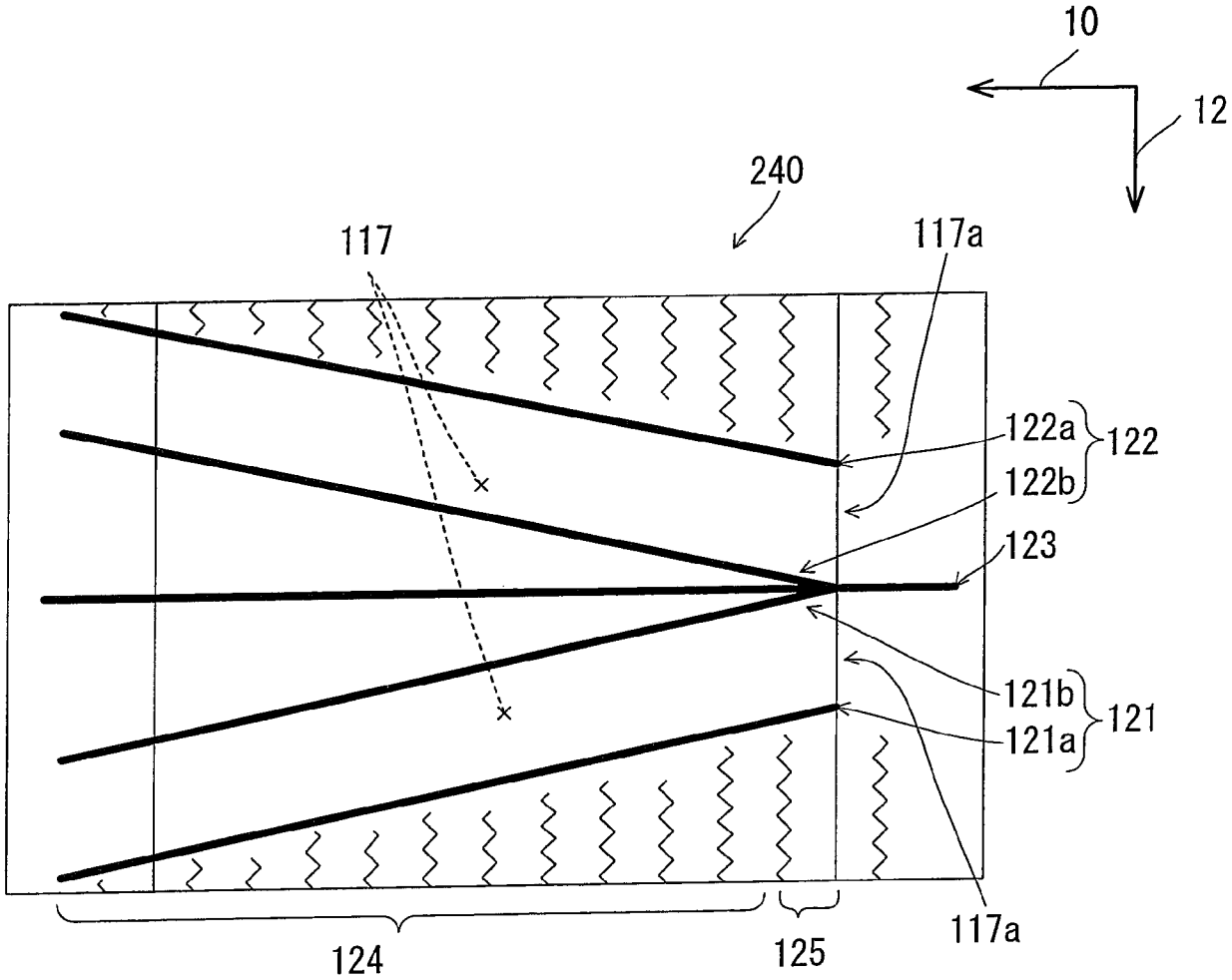
FIG. 10 is a plan view of a cleaning element 240 of a different embodiment.

In the cleaning element 240 shown in FIG. 10, the first outer bonding part 121*a* and the first inner bonding part 121*b* of the first bonding part 121 extend in parallel to each other in the first direction 10 and obliquely with respect to the third bonding part 123. Similarly, the second outer bonding part 122*a* and the second inner bonding part 122*b* of the second bonding part 122 extend in parallel to each other in the first direction 10 and obliquely with respect to the third bonding part 123. Specifically, provided that one end of the cleaning element on the insert opening 117*a* side is taken as its rear end and the other end of the cleaning element on the opposite side is taken as its front end, the first outer bonding part 121*a* and the first inner bonding part 121*b* are bonding lines which extend straight from the rear end to the front end of the cleaning element with a constant spacing therebetween in a direction away from the third bonding part 123. Similarly, the second outer bonding part 122*a* and the second inner bonding part 122*b* are bonding lines extending straight from the rear end to the front end of the cleaning element with a constant spacing therebetween in a direction away from the third bonding part 123. Further, in this embodiment, each of the insert holes 117 is formed as an insert space extending in the first direction 10 as a whole.

Figure 11:
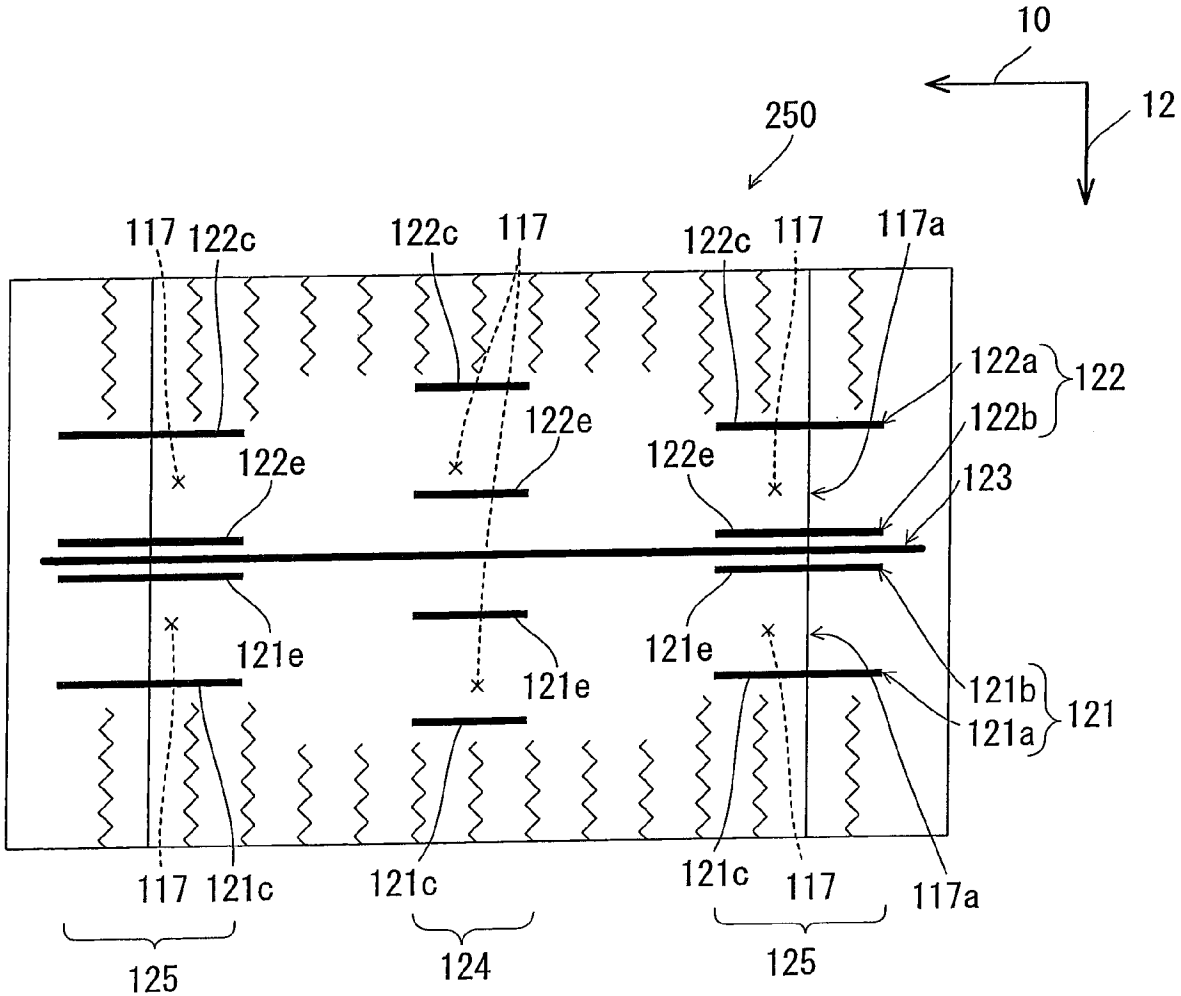
FIG. 11 is a plan view of a cleaning element 250 of a different embodiment.

In the cleaning element 250 shown in FIG. 11, the first outer bonding part 121*a* is formed only by three straight regions 121*c* and does not have the oblique region 121*d* shown in FIG. 3. Further, the first inner bonding part 121*b* is formed only by three straight regions 121*e* and does not have the oblique region 121*f* shown in FIG. 3. Similarly, the second outer bonding part 122*a* is formed only by three straight regions 121*c* and does not have the oblique region 121*d* shown in FIG. 3. Further, the second inner bonding part 122*b* is formed only by three straight regions 122*e* and does not have the oblique region 122*f* shown in FIG. 3. Further, in this embodiment, each of the insert holes 117 is formed as an insert space extending straight in the first direction 10 in part and extending in the first direction 10 as a whole.

Figure 12:
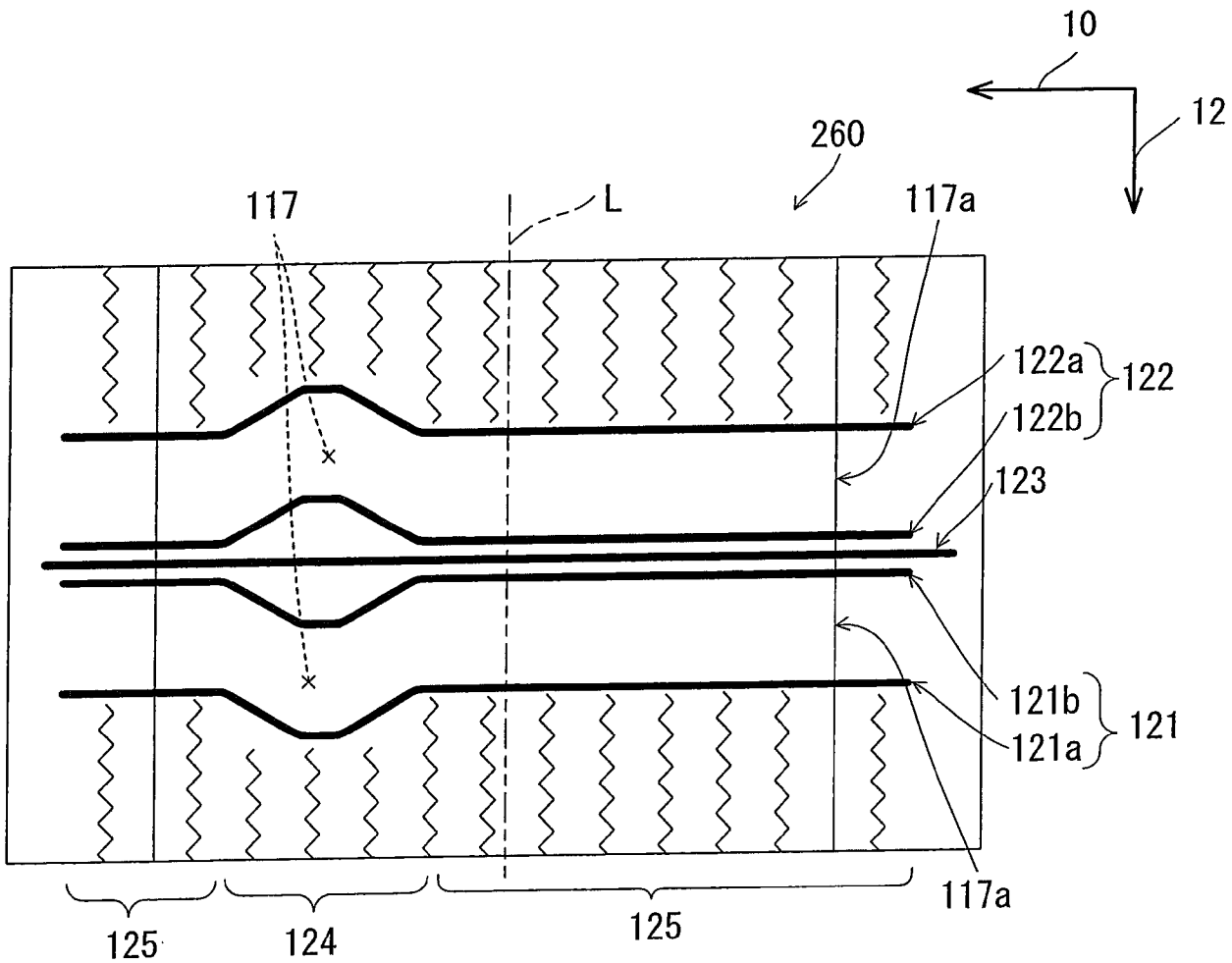
FIG. 12 is a plan view of a cleaning element 260 of a different embodiment.

In the cleaning element 260 shown in FIG. 12, the bonding parts are differently shaped on the both sides of a center line L passing through a middle point of the long side of the cleaning element. Specifically, provided that one end of the cleaning element on the insert opening 117*a* side is taken as its rear end and the other end of the cleaning element on the opposite side is taken as its front end, compared with the cleaning element 110 shown in FIG. 3, the wider part 124 is provided in a position displaced forward of the center line L toward the front end of the cleaning element. Further, in this embodiment, each of the insert holes 117 is formed as an insert space extending straight in the first direction 10 in part and extending in the first direction 10 as a whole.

Figure 13:
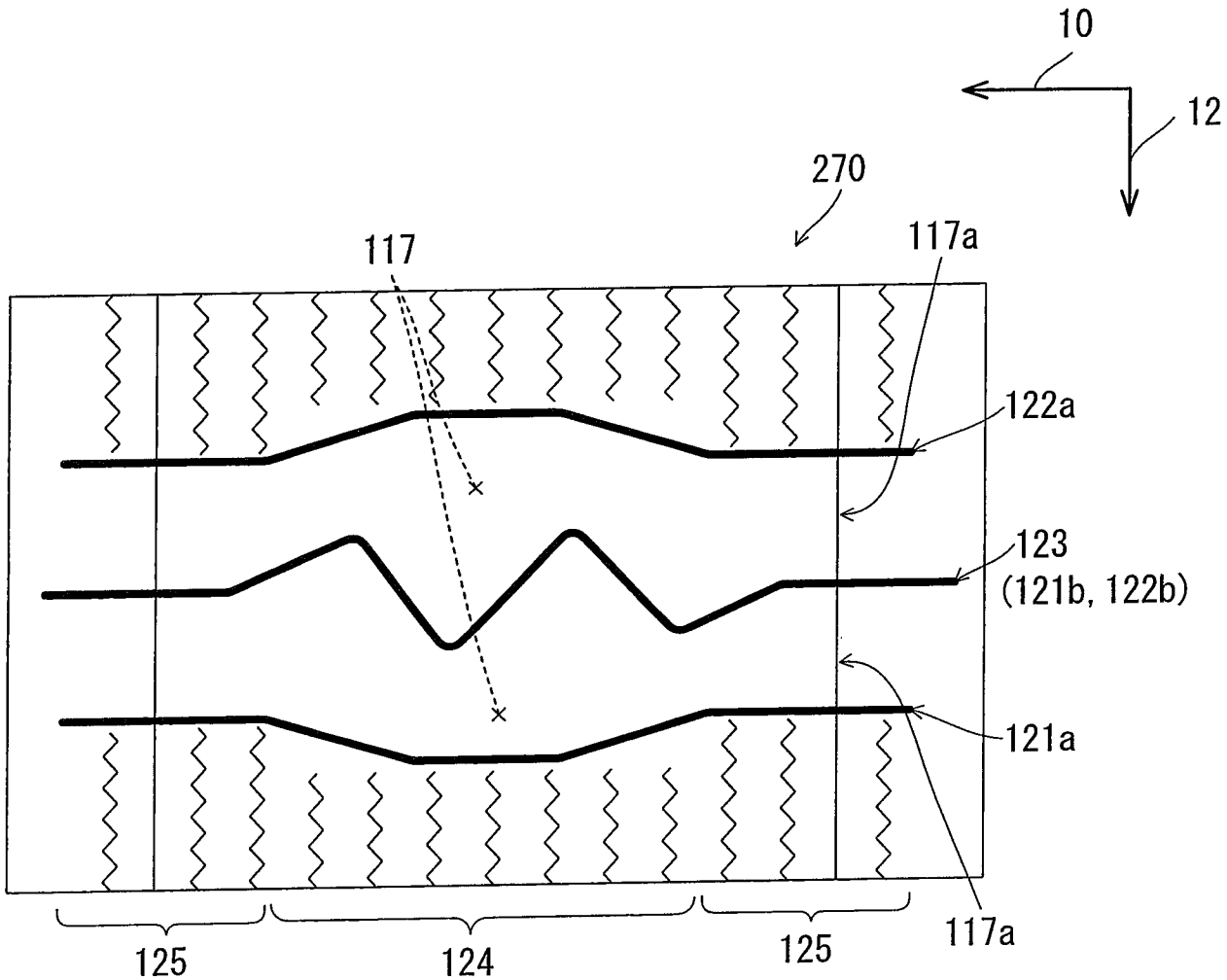
FIG. 13 is a plan view of a cleaning element 270 of a different embodiment.

In the cleaning element 270 shown in FIG. 13, the third bonding part 123 is a bonding line formed by a zigzag line extending in the first direction 10 and having straight lines on both ends of the zigzag line. Further, the third bonding part 123 also has the functions of the first inner bonding part 121*b* of the first bonding part 121 and the second inner bonding part 122*b* of the second bonding part 122. Therefore, the number of the bonding parts can be rationally reduced.

Further, in this embodiment, each of the insert holes 117 is formed as an insert space extending straight in the first direction 10 in part and extending in the first direction 10 as a whole.

Like the cleaning element 110 shown in FIG. 3, the cleaning elements 210, 220, 230, 240, 250, 260, 270 also have at least the wider part 124, and in this point, they have the same effect as the cleaning element 110.

Further, in this invention, the construction of the holding sheet part 111 and the brush part 114 of the cleaning element 110 and areas of the cleaning element 110 which are bonded by the first, second and third bonding parts 121, 122, 123 are not limited to those in the embodiment shown in FIG. 5, but can be appropriately changed as necessary. For example, cleaning elements 310, 320, 330, 340, 350, 360 of other embodiments shown in section in FIGS. 14 to 19 can also be applied.

Figure 14:
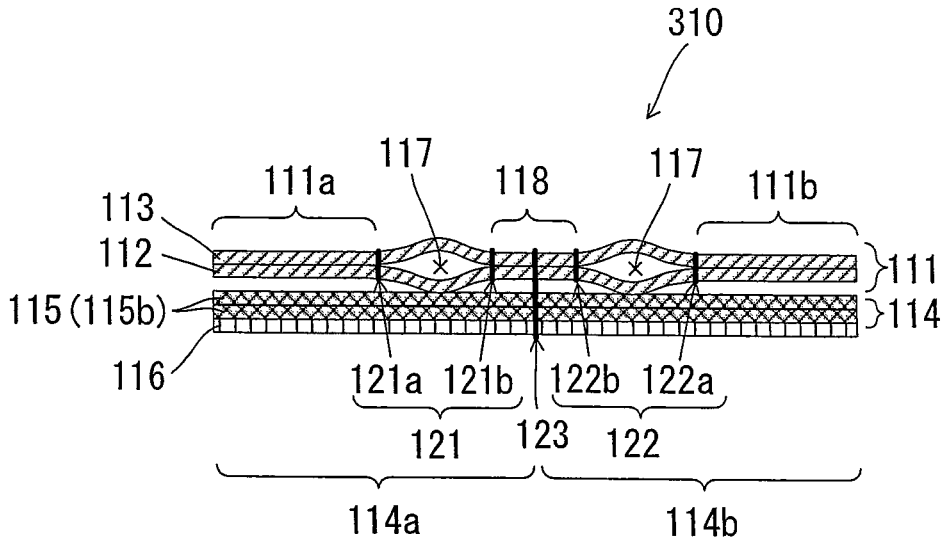
FIG. 14 is a sectional view of a cleaning element 310 of a different embodiment.

In the cleaning element 310 shown in FIG. 14, the fiber assembly 115 is formed only by the fiber element 115*b* formed of a plurality of fibers of the second group. The fiber element 115*b* is connected to the holding sheet part 111 at the third bonding part 123, but the fiber element 115*b* is not connected to the holding sheet part 111 at the first and second bonding parts 121, 122. In this construction, the two insert holes 117 are moved toward each other, so that the holding sheet part 111 in the intermediate region 118 is pushed out in the direction in which the fiber assembly 115 is located with respect to the insert holes 117. By this push, the free ends of the first extending portions 111*a* of the holding sheet part 111 swing on the third bonding part 123 (in the direction of the arrow 20 in FIG. 6), while the free ends of the second extending portions 111*b* of the holding sheet part 111 swing on the third bonding part 123 (in the direction of the arrow 22 in FIG. 6).

Figure 15:
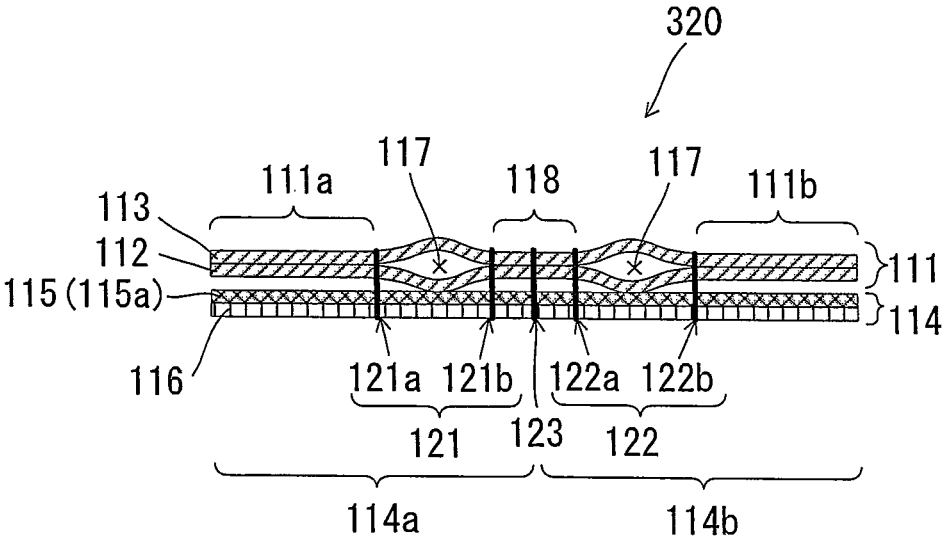
FIG. 15 is a sectional view of a cleaning element 320 of a different embodiment.

In the cleaning element 320 shown in FIG. 15, the fiber assembly 115 is formed only by the fiber element 115*a* formed of a plurality of fibers of the first group. The fiber element 115*a* is connected to the holding sheet part 111 at all of the first, second and third bonding part 121, 122, 123. In this construction, the two insert holes 117 are moved toward each other, so that the holding sheet part 111 and the fiber element 115*a* in the intermediate region 118 are pushed out in the direction in which the fiber assembly 115 is located with respect to the insert holes 117. By this push, the free ends of the first extending portions 111*a* of the holding sheet part 111 and the fiber element 115*a* swing on the third bonding part 123 (in the direction of the arrow 20 in FIG. 6), while the free ends of the second extending portions 111*b* of the holding sheet part 111 and the fiber element 115*a* swing on the third bonding part 123 (in the direction of the arrow 22 in FIG. 6).

Figure 16:
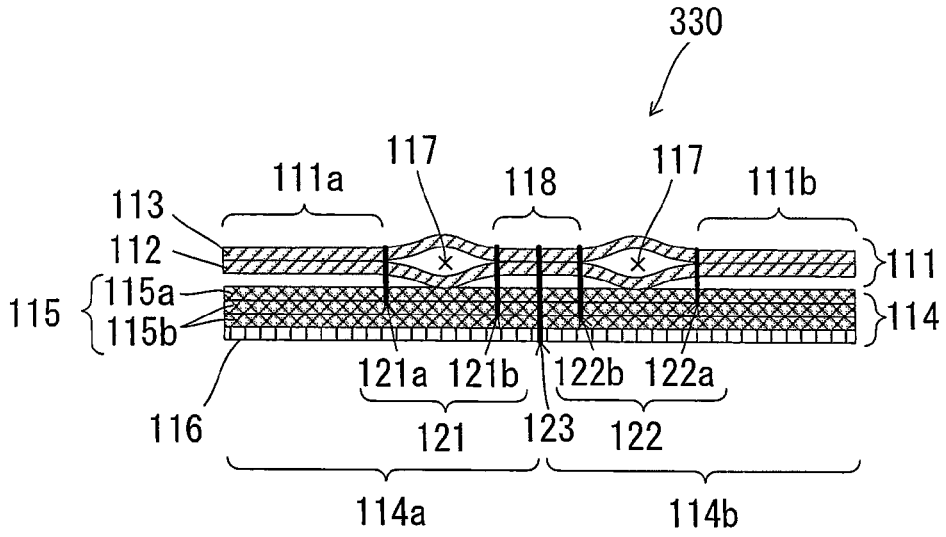
FIG. 16 is a sectional view of a cleaning element 330 of a different embodiment.

In the cleaning element 330 shown in FIG. 16, the fiber assembly 115 is formed by the fiber element 115*a* formed of a plurality of fibers of the first group and the two fiber elements 115*b* formed of a plurality of fibers of the second group. The fiber element 115*a* and one of the fiber elements 115*b* which is disposed on the holding sheet part 111 side are connected to the holding sheet part 111 at the first bonding part 121 or the second bonding part 122. The other fiber element 115*b* is connected to the holding sheet part 111 at the third bonding part 123, but not at the first bonding part 121 or the second bonding part 122. In this construction, the two insert holes 117 are moved toward each other, so that the holding sheet part 111, the fiber element 115*a* and the one fiber element 115*b* in the intermediate region 118 are pushed out in the direction in which the fiber assembly 115 is located with respect to the insert holes 117. By this push, the free ends of the first extending portions 111*a* of the holding sheet part 111 and the fiber element 115*a* swing on the third bonding part 123 (in the direction of the arrow 20 in FIG. 6), while the free ends of the second extending portions 111*b* of the holding sheet part 111 and the fiber element 115*a* swing on the third bonding part 123 (in the direction of the arrow 22 in FIG. 6).

Figure 17:
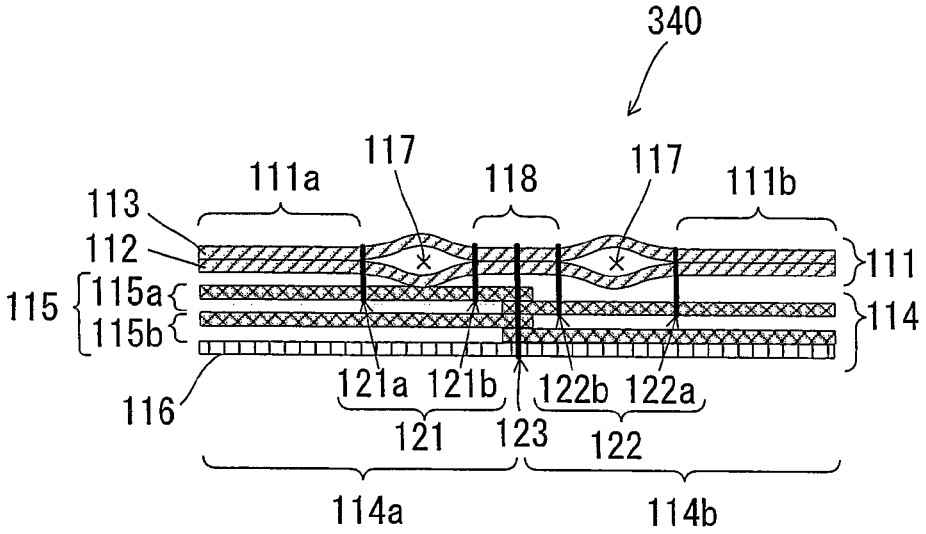
FIG. 17 is a sectional view of a cleaning element 340 of a different embodiment.

In the cleaning element 340 shown in FIG. 17, the fiber assembly 115 is formed by the fiber element 115*a* formed of a plurality of fibers of the first group and the fiber element 115*b* formed of a plurality of fibers of the second group. Further, the fiber element 115*a* is separated into two sheet parts, one on the one insertion hole 117 side and the other on the other insertion hole 117 side. Similarly, the fiber element 115*b* is separated into two sheet parts, one on the one insertion hole 117 side and the other on the other insertion hole 117 side. The two sheet parts of the fiber element 115*a* are connected to the holding sheet part 111 at the first bonding part 121 and the second bonding part 122. The two sheet parts of the fiber element 115*b* are connected to the holding sheet part 111 at the third bonding part 123, but not connected at the first bonding part 121 and the second bonding part 122. In this construction, the two insert holes 117 are moved toward each other, so that the holding sheet part 111 and the fiber element 115*a* in the intermediate region 118 are pushed out in the direction in which the fiber assembly 115 is located with respect to the insert holes 117. By this push, the free ends of the first extending portions 111*a* of the holding sheet part 111 and the one sheet part of the fiber element 115*a* swing on the third bonding part 123 (in the direction of the arrow 20 in FIG. 6), while the free ends of the second extending portions 111*b* of the holding sheet part 111 and the other sheet part of the fiber element 115*a* swing on the third bonding part 123 (in the direction of the arrow 22 in FIG. 6).

Figure 18:
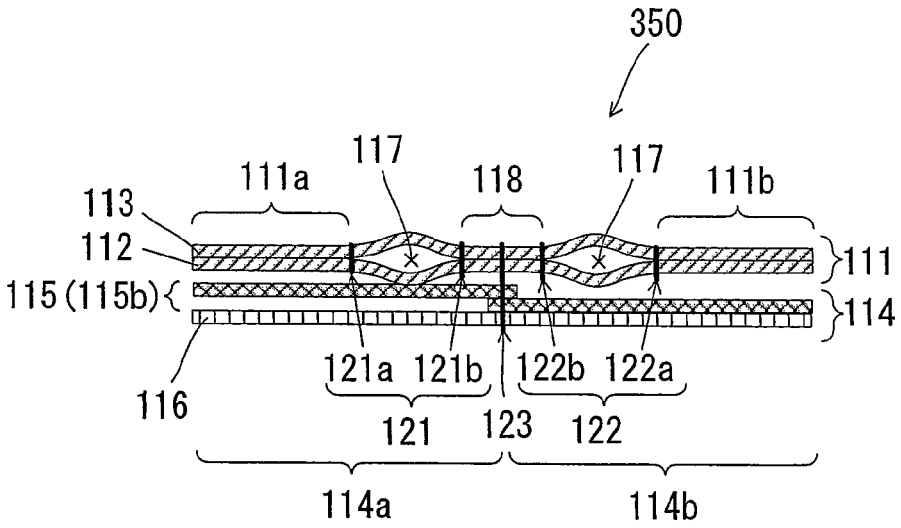
FIG. 18 is a sectional view of a cleaning element 350 of a different embodiment.

In the cleaning element 350 shown in FIG. 18, the fiber assembly 115 is formed only by the fiber element 115*b* formed of a plurality of fibers of the second group. Further, the fiber element 115*b* is separated into two sheet parts, one on the one insertion hole 117 side and the other on the other insertion hole 117 side. The two sheet parts of the fiber element 115*b* are connected to the holding sheet part 111 at the third bonding part 123, but not connected at the first bonding part 121 and the second bonding part 122. In this construction, the two insert holes 117 are moved toward each other, so that the holding sheet part 111 in the intermediate region 118 is pushed out in the direction in which the fiber assembly 115 is located with respect to the insert holes 117. By this push, the free ends of the first extending portions 111*a* of the holding sheet part 111 swing on the third bonding part 123 (in the direction of the arrow 20 in FIG. 6), while the free ends of the second extending portions 111*b* of the holding sheet part 111 swing on the third bonding part 123 (in the direction of the arrow 22 in FIG. 6).

Figure 19:
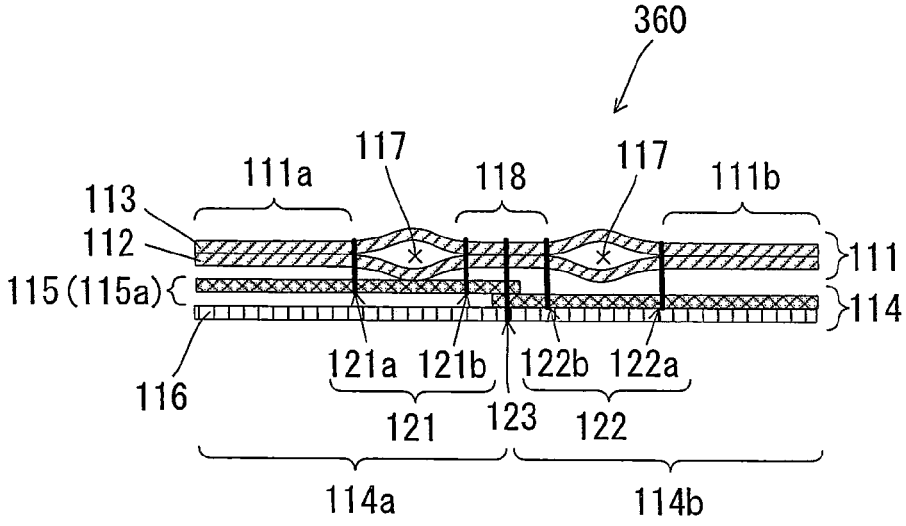
FIG. 19 is a sectional view of a cleaning element 360 of a different embodiment.
Figure 20:
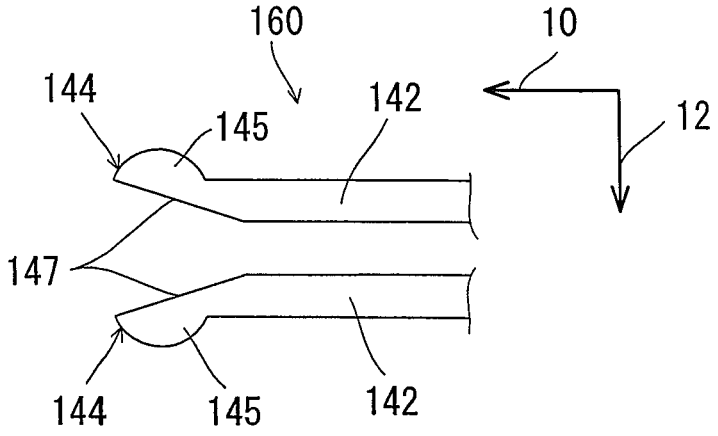
FIG. 20 is a plan view showing part of a holder body 160 of a different embodiment.

In the cleaning element 360 shown in FIG. 19, the fiber assembly 115 is formed only by the fiber element 115*a* formed of a plurality of fibers of the first group. Further, the fiber element 115*a* is separated into two sheet parts, one on the one insertion hole 117 side and the other on the other insertion hole 117 side. The two sheet parts of the fiber element 115*a* are connected to the holding sheet part 111 at all of the first to third bonding parts 121 to 123. In this construction, the two insert holes 117 are moved toward each other, so that the holding sheet part 111 and the fiber element 115*a* in the intermediate region 118 are pushed out in the direction in which the fiber assembly 115 is located with respect to the insert holes 117. By this push, the free ends of the first extending portions 111*a* of the holding sheet part 111 and the one sheet part of the fiber element 115*a* swing on the third bonding part 123 (in the direction of the arrow 20 in FIG. 6), while the free ends of the second extending portions 111*b* of the holding sheet part 111 and the other sheet part of the fiber element 115*a* swing on the third bonding part 123 (in the direction of the arrow 22 in FIG. 6).

Like in the cleaning element 110 shown in FIG. 5, in the cleaning elements 310, 320, 330, 340, 350, 360, 370, the fiber elements in the intermediate region 118 are pushed out in the direction in which the fiber assembly 115 is located with respect to the insert holes 117, so that the thickness of the fiber portions of the fiber assembly 115 on the both sides of the intermediate region 118 increases. Therefore, they also have the effect that the distances between fibers of the fiber assembly 115 can be increased.

In the above-described embodiment, as shown in FIG. 3, the distance d2 between the two holding elements 142 is described as being constant in the first direction 10, but the distance d2 may not be constant in the first direction 10. For example, a holder body 160 of another embodiment may also be applied in which an inclined portion 147 is formed on each of the free ends 144. With such construction, the holding elements 142 can be more easily inserted into the insert holes 117.

Having regard to the nature of the invention, following aspects can be provided:

1. A cleaning tool comprising:

a cleaning element holder comprising a grip to be held by a user, a first holding element and a second holding element, the holding elements respectively extending side by side in an elongate form from the grip and a cleaning element adapted to be held by the cleaning element holder, the cleaning element comprising:

a first insert space and a second insert space which respectively receive the first and second holding elements of the cleaning element holder and extend in a first direction, a first sheet and a second sheet which are formed of non-woven fabric, a first inner bonding part and a first outer bonding part formed by the first and second sheets being overlaid one on the other and being bonded together and which define the first insert space, a second inner bonding part and a second outer bonding part formed by the first and second sheets being overlaid one on the other and being bonded together and which define the second insert space, an intermediate region which is formed between the first inner bonding part and the second inner bonding part, a fiber element formed by a plurality of fibers which extend in a second direction transverse to the first direction and are bonded, at least in part, to the first sheet in the intermediate region, wherein:

the first and second holding elements of the cleaning element holder are adapted to be respectively inserted into the first and second insert spaces of the cleaning element, such that on insertion of the first and second holding elements the first and second insert spaces are moved toward each other, so that the fiber element in the intermediate region is pushed out in a direction in which the fiber element is located with respect to the first and second insert spaces.

2. The cleaning tool as defined in aspect 1, wherein the fiber element is bonded to the first sheet in the intermediate region by an intermediate bonding part which is different from the first and second inner bonding parts and different from the first and second outer bonding parts and extends in the first direction.

3. The cleaning tool as defined in aspect 1 or 2, wherein the fiber element is bonded to the first sheet in the intermediate region by the first and second inner bonding parts.

4. The cleaning tool as defined in any preceding aspect, wherein the fiber element is bonded to the first sheet in the intermediate region by the first and second outer bonding parts.

5. The cleaning tool as defined in aspect 1, wherein the fiber element of the cleaning element includes a plurality of fibers of a first group which are disposed to face the first sheet and a plurality of fibers of a second group which are disposed on the opposite side of the fibers of the first group from the first sheet, and when the first and second insert spaces are moved toward each other, the fibers of the first group swing around the intermediate region.

6. The cleaning tool as defined in aspect 5, wherein, in the cleaning element, the fibers of the first group and the fibers of the second group are bonded to the first sheet in the intermediate region by an intermediate bonding part which is different from the first and second inner bonding parts and extends in the first direction, and the intermediate bonding part is designed as a center of rotation of the fibers of the first group.

7. The cleaning tool as defined in aspect 6, wherein the fibers of the first group are also bonded to the first sheet in the intermediate region by the first and second inner bonding parts.

8. The cleaning tool as defined in aspect 6 or 7, wherein the fibers of the first group are also bonded to the first sheet in the intermediate region by the first and second outer bonding parts.

9. The cleaning tool as defined in any one of aspects 2 to 8, wherein the intermediate bonding part bonds together the fiber element and all the sheets forming the cleaning element so as to form an all-layer joining line.

10 The cleaning tool as defined in aspect 9, wherein the intermediate bonding part, whilst extending in the first direction, is arranged substantially centrally in the cleaning element in the second direction.

11. The cleaning tool as defined in any one of aspects 1 to 10, wherein one side of the second sheet which faces away from the first sheet is defined as a first cleaning surface.

12. The cleaning element as defined in aspect 11, wherein the fiber element provides a second cleaning surface disposed on the opposite side of the cleaning element to the first cleaning surface.

13. The cleaning element as defined in aspect 11, wherein the fiber element is sandwiched between the first sheet and a third sheet, the third sheet providing a second cleaning surface disposed on the opposite side of the cleaning element to the first cleaning surface.

14. The cleaning element as defined in any one of aspects 1 to 14, wherein the fibers of the fiber element extend in a direction transverse to the first direction across both of the first and second insert spaces.

15. The cleaning element as defined in any one of aspects 1 to 14, wherein the length of the side of the second sheet in the first direction is shorter than the length of the side of the first sheet in the first direction.

16. The cleaning element as defined in any one of aspects 1 to 15, wherein the length of the side of the second sheet in the second direction is substantially the same as the length of the side of the first sheet in the second direction.

17 A cleaning element adapted to be held by a cleaning element holder, the cleaning element comprising:

a first insert space and a second insert space which respectively receive the first and second holding elements of the cleaning element holder and extend in a first direction, a first sheet and a second sheet which are formed of non-woven fabric, a first inner bonding part and a first outer bonding part formed by the first and second sheets being overlaid one on the other and being bonded together and which define the first insert space, a second inner bonding part and a second outer bonding part formed by the first and second sheets being overlaid one on the other and being bonded together and which define the second insert space, an intermediate region which is formed between the first inner bonding part and the second inner bonding part, a fiber element formed by a plurality of fibers which extend in a second direction transverse to the first direction and are bonded, at least in part, to the first sheet in the intermediate region, wherein:

the first and second holding elements of the cleaning element holder are adapted to be respectively inserted into the first and second insert spaces of the cleaning element, such that on insertion of the first and second holding elements the first and second insert spaces are moved toward each other, so that the fiber element in the intermediate region is pushed out in a direction in which the fiber element is located with respect to the first and second insert spaces.

18 The cleaning tool as defined in aspect 17, wherein the fiber element is bonded to the first sheet in the intermediate region by an intermediate bonding part which is different from the first and second inner bonding parts and different from the first and second outer bonding parts and extends in the first direction.

19. The cleaning tool as defined in aspect 17 or 18, wherein the fiber element is bonded to the first sheet in the intermediate region by the first and second inner bonding parts.

20. The cleaning tool as defined in any preceding aspect, wherein the fiber element is bonded to the first sheet in the intermediate region by the first and second outer bonding parts.

21. The cleaning tool as defined in aspect 17, wherein the fiber element of the cleaning element includes a plurality of fibers of a first group which are disposed to face the first sheet and a plurality of fibers of a second group which are disposed on the opposite side of the fibers of the first group from the first sheet, and when the first and second insert spaces are moved toward each other, the fibers of the first group swing around the intermediate region 22. The cleaning tool as defined in aspect 21, wherein, in the cleaning element, the fibers of the first group and the fibers of the second group are bonded to the first sheet in the intermediate region by an intermediate bonding part which is different from the first and second inner bonding parts and extends in the first direction, and the intermediate bonding part is designed as a center of rotation of the fibers of the first group.

23. The cleaning tool as defined in aspect 22, wherein the fibers of the first group are also bonded to the first sheet in the intermediate region by the first and second inner bonding parts.

24. The cleaning tool as defined in aspect 22 or 23, wherein the fibers of the first group are also bonded to the first sheet in the intermediate region by the first and second outer bonding parts.

25. The cleaning tool as defined in any one of aspects 18 to 24, wherein the intermediate bonding part bonds together the fiber element and all the sheets forming the cleaning element so as to form an all-layer joining line.

26 The cleaning tool as defined in aspect 25, wherein the intermediate bonding part, whilst extending in the first direction, is arranged substantially centrally in the cleaning element in the second direction.

27. The cleaning tool as defined in any one of aspects 17 to 26, wherein one side of the second sheet which faces away from the first sheet is defined as a first cleaning surface.

28. The cleaning element as defined in aspect 27, wherein the fiber element provides a second cleaning surface disposed on the opposite side of the cleaning element to the first cleaning surface.

29. The cleaning element as defined in aspect 27, wherein the fiber element is sandwiched between the first sheet and a third sheet, the third sheet providing a second cleaning surface disposed on the opposite side of the cleaning element to the first cleaning surface.

30. The cleaning element as defined in any one of aspects 17 to 29, wherein the fibers of the fiber element extend in a direction transverse to the first direction across both of the first and second insert spaces.

31. The cleaning element as defined in any one of aspects 17 to 30, wherein the length of the side of the second sheet in the first direction is shorter than the length of the side of the first sheet in the first direction.

32. The cleaning element as defined in any one of aspects 17 to 31, wherein the length of the side of the second sheet in the second direction is substantially the same as the length of the side of the first sheet in the second direction.

DESCRIPTION OF NUMERALS

100 cleaning tool
110 cleaning element
110*a* long side
110*b* short side
111 holding sheet part
111*a* first extending portion
111*b* second extending portion
112 first sheet
112*a* strip
113 second sheet
113*a* strip
114 brush part
114*a* first extending portion
114*b* second extending portion
115 fiber assembly
115*a*, 115*b* fiber element
116 third sheet
116*a* strip
117 insert hole
117*a* insert opening
118 intermediate region
118*a* strip
121 first bonding part
121*a* first outer bonding part
121*b* first inner bonding part
121*c*, 121*e* straight region
121*d*, 121*f* oblique region
122 second bonding part
122*a* second outer bonding part
122*b* second inner bonding part
122*c*, 122*e* straight region
122*d*, 122*f* oblique region
123 third bonding part
124 wider part
130 cleaning element holder
140 holder body
141 connection
142 holding element
142*a* outer edge
143 fixed end
144 free end
145 protruding piece
146 retaining plate
150 handle
151 handle body
160 holder body

The invention claimed is:

1. A cleaning tool comprising:

a cleaning element holder comprising a grip to be held by a user, a first holding element and a second holding element, the holding elements respectively extending side by side in an elongate form from the grip and a cleaning element adapted to be held by the cleaning element holder, the cleaning element comprising:

a first insert space and a second insert space which respectively receive the first and second holding elements of the cleaning element holder and extend in a first direction, a first sheet and a second sheet which are formed of non-woven fabric, a first inner bonding part and a first outer bonding part formed by the first and second sheets being overlaid one on the other and being bonded together and which define the first insert space, a second inner bonding part and a second outer bonding part formed by the first and second sheets being overlaid one on the other and being bonded together and which define the second insert space, an intermediate region which is formed between the first inner bonding part and the second inner bonding part, a fiber element formed by a plurality of fibers which extend in a second direction transverse to the first direction and are bonded, at least in part, to the first sheet in the intermediate region, wherein:

the first and second holding elements of the cleaning element holder are adapted to be respectively inserted into the first and second insert spaces of the cleaning element, such that on insertion of the first and second holding elements the first and second insert spaces are moved toward each other, so that the fiber element in the intermediate region is pushed out in a direction in which the fiber element is located with respect to the first and second insert spaces;

the fiber element of the cleaning element includes a plurality of fibers of a first group which are disposed to face the first sheet and a plurality of fibers of a second group which are disposed on the opposite side of the fibers of the first group from the first sheet, and when the first and second insert spaces are moved toward each other, the fibers of the first group swing around the intermediate region; and in the cleaning element, the fibers of the first group and the fibers of the second group are bonded to the first sheet in the intermediate region by an intermediate bonding part which is different from the first and second inner bonding parts and extends in the first direction, and the intermediate bonding part is designed as a center of rotation of the fibers of the first group.

2. The cleaning tool as defined in claim 1, wherein the fiber element is bonded to the first sheet in the intermediate region by an intermediate bonding part which is different from the first and second inner bonding parts and different from the first and second outer bonding parts and extends in the first direction.

3. The cleaning tool as defined in claim 2, wherein the intermediate bonding part bonds together the fiber element and all the sheets forming the cleaning element so as to form an all-layer joining line.

4. The cleaning tool as defined in claim 3, wherein the intermediate bonding part, whilst extending in the first direction, is arranged substantially centrally in the cleaning element in the second direction.

5. The cleaning tool as defined in claim 1, wherein the fiber element is bonded to the first sheet in the intermediate region by the first and second inner bonding parts.

6. The cleaning tool as defined in claim 1, wherein the fiber element is bonded to the first sheet in the intermediate region by the first and second outer bonding parts.

7. The cleaning tool as defined in claim 1, wherein the fibers of the first group are also bonded to the first sheet in the intermediate region by the first and second inner bonding parts.

8. The cleaning tool as defined in claim 1, wherein the fibers of the first group are also bonded to the first sheet in the intermediate region by the first and second outer bonding parts.

9. The cleaning tool as defined in claim 1, wherein one side of the second sheet which faces away from the first sheet is defined as a first cleaning surface.

10. The cleaning element as defined in claim 9, wherein the fiber element provides a second cleaning surface disposed on the opposite side of the cleaning element to the first cleaning surface.

11. The cleaning element as defined in claim 9, wherein the fiber element is sandwiched between the first sheet and a third sheet, the third sheet providing a second cleaning surface disposed on the opposite side of the cleaning element to the first cleaning surface.

12. The cleaning element as defined in claim 1, wherein the fibers of the fiber element extend in a direction transverse to the first direction across both of the first and second insert spaces.

13. The cleaning element as defined in claim 1, wherein the length of the side of the second sheet in the first direction is shorter than the length of the side of the first sheet in the first direction.

14. The cleaning element as defined in claim 1, wherein the length of the side of the second sheet in the second direction is substantially the same as the length of the side of the first sheet in the second direction.

* * * * *